US006194108B1

(12) United States Patent
Akutsu et al.

(10) Patent No.: US 6,194,108 B1
(45) **Date of Patent: *Feb. 27, 2001**

(54) IMAGE FORMING METHOD AND IMAGE FORMING DEVICE USING SAME

(75) Inventors: Eiichi Akutsu; Shigemi Ohtsu; Satoshi Tatsuura; Lyong Sun Pu, all of Nakai-machi (JP)

(73) Assignee: Fuji Xerox Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/944,835

(22) Filed: Oct. 6, 1997

(30) Foreign Application Priority Data

Oct. 17, 1996 (JP) ..... 8-274768
Jan. 14, 1997 (JP) ..... 9-004834

(51) Int. Cl.[7] ..... G03G 9/08; G03G 9/12

(52) U.S. Cl. ..... 430/32; 430/117

(58) Field of Search ..... 430/117, 119, 430/32

(56) References Cited

U.S. PATENT DOCUMENTS

| | | | | |
|---|---|---|---|---|
| 3,172,826 | * | 3/1965 | Tulagin et al. | 430/52 |
| 3,247,081 | * | 4/1966 | Reithel | 430/52 |
| 3,402,111 | * | 9/1968 | Ville | 430/52 |
| 3,527,684 | * | 9/1970 | York et al. | 430/52 |
| 4,257,347 | * | 3/1981 | Stahl | 430/119 |
| 4,525,446 | * | 6/1985 | Uytterhoeven et al. | 430/119 |

FOREIGN PATENT DOCUMENTS

| | | |
|---|---|---|
| 60-23051 | 2/1985 | (JP) . |
| 63-237085 | 10/1988 | (JP) . |
| A-4-9902 | 1/1992 | (JP) . |
| 2 6-41221 | 6/1994 | (JP) . |
| A-6-293125 | 10/1994 | (JP) . |
| B2-7-54407 | 6/1995 | (JP) . |
| A-7-181750 | 7/1995 | (JP) . |
| 63-286480 | 6/1998 | (JP) . |

OTHER PUBLICATIONS

H. Tanemura et al., "High Image Quality Color Copying System Using Silver Salt Photography"< Japan Hardcopy '89, Proceedings for Meeting for Reporting Researches, p. 229 etc.

E. B. Caruthers, et al., "Modeling of Liquid Toner Electrical Characteristics", Proceedings of IS&T 10$^{th}$ Int'l. Congress on Advances in Non–Impact Printing Technologies, p. 204 ('94) etc.

M. Usui, "Development of New System MACH", Japan Hardcopy '96, Proceedings for a Meeting for Reporting Researches, p. 161 etc. Electrophotography Society, Proceedings for the Discussion on Researches, p. 32 (1971).

Electrophotography Society, Proceedings for the Discussion on Researches, p. 24, (1964.11).

A Guide for Printing Ink, pp. 49–50, 145–146.

Printing technology (pp. 66, 67), 1995.

* cited by examiner

*Primary Examiner*—John Goodrow
(74) *Attorney, Agent, or Firm*—Oliff & Berridge, PLC

(57) ABSTRACT

A method of forming an image comprising the steps of: preparing a device in which an image holding element which can functions as one of electrodes pair and which has a surface for holding an image and an opposite electrode which is the other of the electrodes pair are immersed in a dispersion of a coloring material fine particles in which ionized coloring material fine particles are dispersed in an aqueous liquid, and applying electric current to a desired area of the image holding element and the opposite electrode through the dispersion and depositing-building-up the coloring material fine particles to the desired area electrochemically to form an image, is disclosed.

37 Claims, 6 Drawing Sheets

IMAGE FORMING METHOD AND IMAGE FORMING DEVICE USING SAME

BACKGROUND OF THE INVENTION

The present invention relates to a method of forming an image by an electrochemical deposition·build-up phenomenon, using a dispersion in which coloring material fine particles are dispersed in an aqueous solvent, and to a device for carrying out the method.

When an image is formed, it is considered that the image thickness may be preferably 2 μm or less, more preferably 1 μm or less in view of the relation between the duplicated area of colors and sharpness of images in order to attain a high image quality (10000DPI level of resolution/color duplication/variable gradation). Accordingly, the average geometry of the image forming material which is a factor providing image structure is needed to be 1 μm or less. If the average geometry of the image forming material is 5 μm or less powders, there occurred a problem on the fluidity. In the view point, it is considered that the powdered image forming material is very difficult in use, and that, on the other hand, the liquid image forming material is useful. As the latter image recording technologies, for example, the silver salt technologies, ink jet technologies, liquid development electrophotography technologies may be exemplified as representative examples.

1) The printing technologies using silver salt is described in H.Tanemura et al., "High image quality color copying system using silver salt photography", Japan Hardcopy '89, proceedings for meeting for reporting researches, p229 etc.

2) The printing technologies using liquid development electrophotography is described in E. B. Caruthers, et al., "Modeling of Liquid Toner Electrical Characteristics", Proceedings of IS&T 10th Int'l. Congress on Advances in Non-Impact Printing Technologies, p204 ('94) etc.

3) The printing technologies using ink jet technique are described-in many papers such as M. Usui, "Development of New System MACH", Japan Hardcopy '96, proceedings for a meeting for reporting researches, p161 etc.

As the conventional technologies which can be seemed to be similar to the present invention comprising forming images utilizing liquid, the following methods have been known.

4) The method of forming images using electrodeposition liquid, in which coloring materials are dispersed in an insulating liquid and an electric double-layer is formed (JP 7-181750 A, JP7-54407 B), the method of forming fine patterns, using an electrodeposition printing technology in which an insulating pattern is arranged on a conductive substrate to be used as a plate, and the electrodeposition offset printing method (JP4-9902 A, JP6-293125, A).

5) Electrolytic development method, which is shown in Electrophotography Society, proceedings for the discussion on researches, p32 (1971) and Electrophotography Society, proceedings for the discussion on researches, p24 (1964.11). The electrolytic development method comprising the steps of reducing zinc oxide by applying 10 V or more of voltage and exposing at the same time, moving the electrons thus produced to a dye precursor dissolved in a color development so as to reduce, and depositing·coloring the dye on the surface of the zinc oxide film so as to form an image.

Among the conventional printing technologies, the 1) printing technology using silver salt has no problem on image quality and image fastness, but it has problems on the applicability for the uses in offices since the method is the printing process accompanied with chemical reactions and chemically active reagents are used and wastes are produced.

With the 2) ink jet printing technology, the high resolution can not be obtained by the problems on the nozzle diameter and the reliability of printing. Further since the image forming materials are generally aqueous dyes, there are problems on image fastness, safety and normal paper printing characteristics.

With the 3) electrophotography using an insulating liquid development has no problem on image quality, normal paper printing characteristics and image fastness equal to printing. However, since the printing process is complicated, the machine size becomes large and there are problems on safety and reliability. In addition, the safety of the solvent vapor of the hydrocarbon solvents of the development is regarded as a big problems, and there are some cases in which the uses of the technology are strictly restricted by the government.

Since the above conventional electrodeposition printing technologies using an insulating pattern formed on a conductive substrate as a plate, have complicated process such as that a non-image area of an insulating photoresist must be formed by a photolithography process previously, it is difficult to carry out printing by changing image patterns every time, the precision of the device is high, the device is large-scaled, the number of steps are many and many wastes are produced. Therefore, it can not be used only when printing works are carried out when the device is arranged in a well-equipped factory. In addition, the history of the image forming process is easily remained on an substrate, and the reproducibility of fine image record is low. Since the image area is made depression, the fluidity of the particles on the image area is low, and deposition·build-up selectivity of the particles are lowered, and many liquid component of the image forming materials on the image area will tend to be remained. Accordingly, the viscosity is lowered, and the image forming materials on the image area may fluidize and produce cohesive fail frequently in the transfer process, and a high image quality can not be obtained easily.

The conventional printing technique 5) using the aqueous dye liquid as a electrodeposition liquid has no problem on vapor of organic solvent, and since the minimum picture element is in the order of dye molecule, it is sufficiently small as several 10 Å so that there are no problem on the high resolution. However, since the image area has an aqueous dye as a main component, there remains the problems on image fastness, safety (inhibition of suction by human bodies), high optical density of images.

As mentioned above, the technologies 2) to 5) as well as the technology 1) do not completely meet the requirements required for image forming technologies used in office (i.d., characteristics such as color high image quality of 1000DPI or more/variable gradient, capability of printing on normal paper, image fastness equal to printing, high safety of printed recorded matters and printing machine, few waste products, low running cost, the capability of making small amount and many types of prints easily and low-costly using no unrecyclable plate).

SUMMARY OF THE INVENTION

An object of the present invention is to provide a method of forming a image which is excellent in image quality, image fastness, safety, and a device for carrying out the method.

Another object of the present invention is to provide a method of forming a image by which wastes are scarcely produced, amount of consumed energy is very low, and processes and equipments are simple, and a device for carrying out the method.

Still another object of the present invention is to provide a method of forming a image which can be applicable to the small amount and many types of print production using no plate, and a device for carrying out the method.

In other words, the main object of the present invention is to provide a method of forming a image which can accomplish the various characteristics required for image forming technologies, especially the uses in offices and a device for carrying out the method.

DETAILED DESCRIPTION OF THE PRESENT INVENTION

The method of forming an image of the present invention which can attain the above objects comprising the steps of: preparing a device in which an image holding element which can functions as one of electrodes pair and which has an surface for holding an image and an opposite electrode which is the other of the electrodes pair are immersed in a dispersion of a coloring material fine particles in which ionized coloring material fine particles are dispersed in aqueous liquid, and applying electric current to the desired area of the image holding element and the opposite electrode through the dispersion and depositing·building-up the coloring material fine particles electrochemically to the desired area to form an image.

Figure 1:
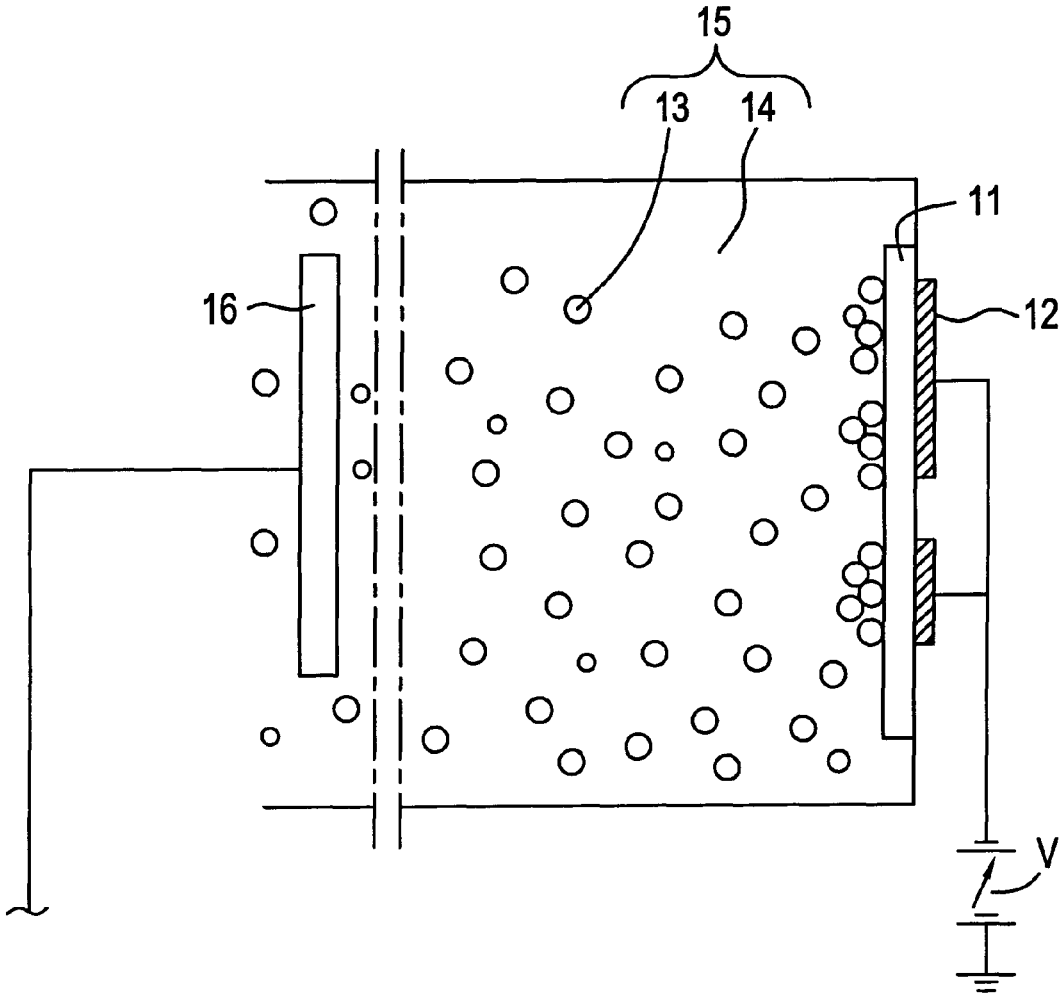
FIG. 1 shows schematically a representative example of the image forming method of the present invention.

The functions of the present invention will be explained with referring FIG. 1 which shows schematically a representative example of the method of forming an image of the present invention.

When applying a voltage to an image holding element 11 using an auxiliary electrode 12 (which is an electrode connected to the power supply V, also referred to as a cooperation electrode, hereinafter) contacted to a part of the image holding element 11, the area of the image holding element 11 essentially corresponding to the auxiliary electrode 12 is functioned (based on the conductivity or electric resistivity of the image holding element 11) as one of electrodes pair, and current is flowing between the corresponding area of the image holding element 11 to the auxiliary electrode 12 and the opposite electrode 16 via the dispersion of the coloring material fine particles 15 in which the ionized coloring materials fine particles 13 are dispersed in an aqueous liquid 14. Accordingly, the ionized coloring material fine particles 13 are sucked and deposited·built-up to the corresponding area having the opposite polarity compared with the particles of the image holding element 11 to the auxiliary electrode to form an image. The auxiliary electrode 12 can be used and the image holding element 11 can be applied voltage directly, so that the auxiliary electrode 12 is not essential.

Further, the opposite electrode may be immersed in or contacted with a different solution from the above aqueous liquid, and the solution may be connected with the above aqueous liquid with a salt bridge. It means that the opposite electrode is essentially contacted with the above aqueous liquid.

Since the method of the present invention uses a liquid for forming an image, coloring material fine particles of 1 mm or less as a coloring material of image forming material maybe used. Therefore, high image quality (1000DPI/variable gradation or more) may be accomplished. Further since the coloring materials of pigments, the coloring materials can meet the requirements of fastness of images, high optical densities and safety, i.e., the coloring materials are not took in human bodies.

In addition; since an aqueous liquid is used as a liquid used, the method of the invention is carried out in safely from the viewpoint.

Further, the plate is unnecessary, and image information can be made by inputting image signals at the every printing time. Therefore a small amount and many types of printing can be made easily and economically.

With the method of the present invention, the amount of consumed energy is low, the processes and equipments are simple and easy. Thus the running cost is low and wastes are scarcely produced.

The method of forming an image of the present invention further comprise a step of transferring the image forming material deposited on the image pattern area of the surface of the image holding element to a recording medium to form an image. In this case, the printing output can be made on the surface of normal paper.

The above method can be carried out using an image forming device having a vessel for a dispersion of coloring material fine particles in which ionized coloring material fine particles are dispersed in an aqueous liquid, an image holding element which is capable of functioning as one of electrodes pair and which has an area for holding area, and an opposite electrode which is the other of the electrodes pair set in the vessel.

Hereinafter, the present invention will be explained in more detail with the following embodiment.

With a representative embodiment of the method of forming an image of the present invention, a dispersion of coloring material fine particles in which ionized coloring material fine particles are dispersed in an aqueous liquid is prepared at first.

The ionization of the coloring material fine particles is carried out by having a group which itself is capable of dissociating or with the help of a reagent (under-mentioned dispersant). The ionized coloring material fine particles is preferably the particles in which a dispersant is adsorbed to the coloring material fine particles. Since coloring material which are able to disperse in fine particles form in an aqueous liquid may be used in the present invention, the present invention has an advantages that a wide-ranging coloring material particles may be used. When forming an image, the coloring material fine particles and the reagent thereof are contributed.

As the coloring material fine particles, water-insoluble or scarcely water-soluble dyes or pigments and oil-soluble dyes are suitable, and disperse dyes, in-mold decorating lake pigments and resin powders in which color matters are contained in the resin, may be used.

As examples of the above dyes and pigments, acid dyes, in particular acid dye having carboxylic acid group as a free base, e.g., Rose Bengal (C. I. Acid Red 94), color matter, erythrosine, Gardenia blue color matter, base dyes, in particular base dye having amino group or a derivative group thereof, e.g., victoria blue B, rhodamine 6G, methylene blue as a dye; carbon black, titanium oxide, zinc white, blood red, alumina white, aluminum powders, bronze powder, zinc oxide, barium sulphate, magnesium carbonate, ultramarine blue, chrome yellow, cobalt blue and Prussian blue as an inorganic pigment; toluidine red, permanent carmine FB, fast yellow G, disazo yellow AAA, disazo orange PMP, lake red C, brilliant carmine 6B, phthalocyanine blue, indanthrone blue, quinacridone red, dioxazine violet, C. I. Pigment Blue 1, alkali blue toner, aniline black, permanent red 2B, barium lithol red, quinacridone magenta, naph-thol red HF4B, phthalocyanine green and benzimidazolone red as an organic pigment, may be exemplified.

As examples of the oil-soluble dyes, victoria blue 4R base, nigrosine, nigrosine base, C.I. Solvent Yellow 19, C.I. Solvent Orange 45 and C.I. Solvent Red 8 may be exemplified.

The average particle diameter of the coloring material fine particles is usually in the range from 0.01 $\mu$m to 1.0 $\mu$m, preferably from 0.06 $\mu$m to 0.3 $\mu$m. If the average particle diameter is less than the range, shielding ability of the image layer is lowered, optical image density is easily decreased, excessive gloss is produced on the image, and problems on safety will be easily occurred. If the average particle diameter is higher than the range, dispersing condition of the dispersion of the coloring material fine particles is deteriorated, troubles on the uniformity of the image layer containing the coloring material fine particles will be occurred, and excessive matting will be easily made. Since if it is less than 0.06 $\mu$m, the dispersing quality is excellent but the optical density will easily be lowered, the above range from 0.06 $\mu$m to 0.3 $\mu$m is preferable.

The aqueous liquid in which the coloring material fine particles are dispersed, is water and an optional solvent which is hydrophilic and which may be admitted as a water-soluble solvent in chemical field (e.g., alcohols such as methanol, ethanol, butanol and isopropyl alcohol, ketones such as acetone and methyl ethyl ketone, a variety of amines such as ethanol amine, dimethyl amine, triethanol amine, acids such as acetic acid, sulfuric acid, phosphoric acid, oxalic acid, phthalic acid). The solvents may be suitably used alone, or a plurality of the solvents may be mixed and used. In particular, a mixed solvent containing water as a main component is useful in view of safety, stability and economy. The aqueous liquid added by water-insoluble solvent may be used in the present invention, provided that the desired effects of the present invention can be obtained.

In order to obtain dispersion stability of the coloring material fine particles, and to produce and/or keep a stable dispersing or ionizing conditions causing deposition·adsorption phenomenon of the coloring material fine particles to the image holding element, a dispersing agent is added to the coloring material fine particles. The dispersing agent is a material having an electrical character which adsorbs on the surface of the coloring material fine particles (by bonding, adhesion or association), and which stabilizes the dispersion of the coloring material fine particles. In addition, if necessary, a variety of additives may be added, e.g., humectants, water-soluble macromolecular materials, emulsifying agent, latex materials and various solvents. The additives may be explained concretely after explaining the indispensable steps of the method of the present invention, for convenience' sake.

As to the composition of the dispersion of the coloring material fine particles (it is also referred simply as 'dispersion' hereinafter), the solids content is usually from 1 wt % to 40 wt %, preferably from 5 wt % to 18 wt %. If the solids content concentration is less than 1 wt %, there is a possibility of the troubles e.g., that the dispersion stability of the coloring material components can not be easily obtained and that the optical density of images can not be easily obtained. If the solids content concentration is higher than 40 wt %, there are problems e.g., that the liquid will be uniform at the time of the formation of images, and that the handling of the liquid will become complicated since the liquid shows thixotropy.

In the solid components of the dispersion, the content of the coloring material in solid contents is usually from 30 wt % to 80 wt %, preferably from 40 wt % to 60 wt %. If the content is less than the above range, the gloss of images becomes too high and the optical density of images is decreased. If the content is higher than the above range, the particles deposition efficiency is decreased, defects and failures may be easily occurred in forming layers of images, and the fixing strength is lowered and problems on color tones will be occurred.

The volume resistivity of the dispersion is usually $10^5$ Ω·cm or less, preferably $10^3$ Ω·cm or less. If it is higher than the above range, the voltage for deposition of color material is increased, the foaming phenomenon of the electrodes are activated, the deposition phenomenon is made unstable, and the variation of the film quality of the coloring material will be easily occurred.

The viscosity of the dispersion is preferably in the range from 1 cps to 1000 cps, more preferably in the range from 10 cps to 200 cps. If it is less than the above range, the scattering of the liquid drops will occur due to the deficiency of the viscosity of the liquid. If it is higher than the above range, problems on the decrease of efficiency will occur in carrying and stirring the dispersion liquid due to the high loading in working.

Figure 2:
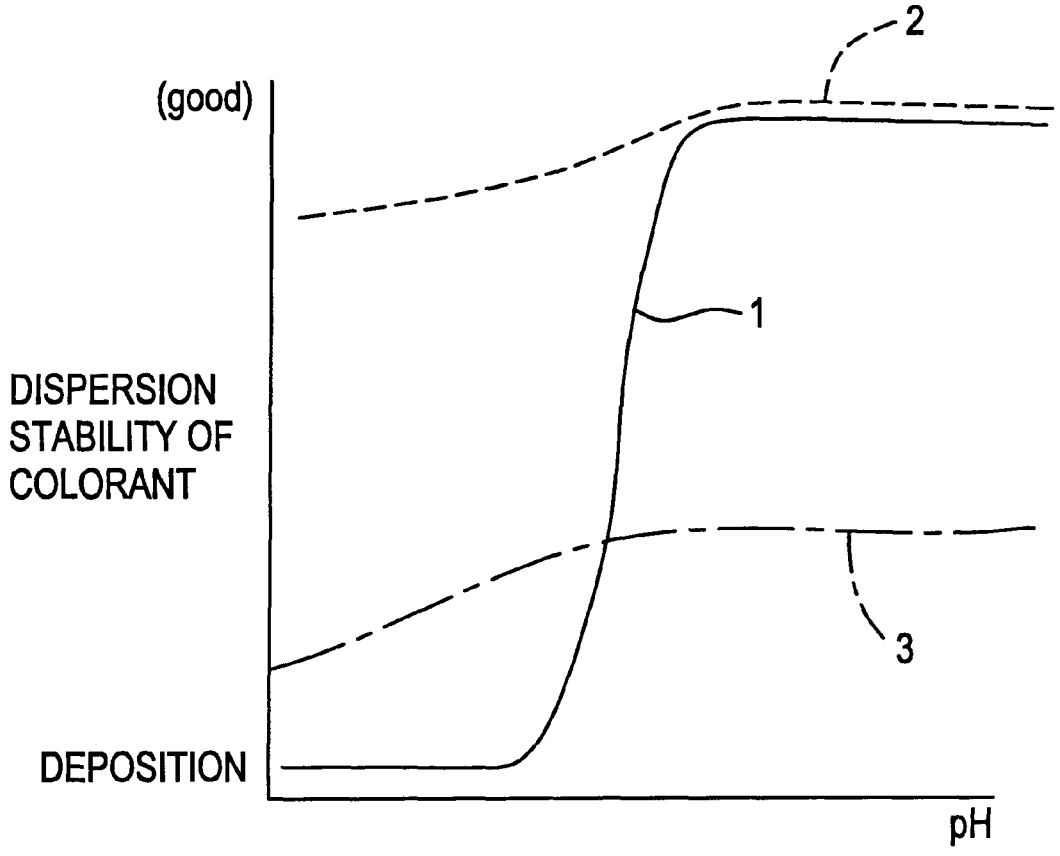
FIG. 2 shows the relation of the pH and the dispersing stability of the dispersion.

The dispersion stability of the coloring fine particles of the dispersion is usually varied depending on the change of pH. For example, as shown in FIG. 2, the system (curve 1) which has a clear tendency that the dispersion of the coloring material is stable in alkali and it is settled in acid, is applicable for the present invention suitably. The system (curve 2) which has a tendency that the dispersing quality is high even if pH is changed or the system (curve 3) which has a tendency that the settling properties is high, are not applicable for the present invention. The reason is that pH variations of the dispersion is generally accompanied at the time of applying current in the later image forming process by which the coloring material is deposited.

At the pH setting of the dispersion, the pH value is set between +0 to +4 compared with the pH point at the beginning of the deposition [i.e, pH value at the beginning to (pH value at the beginning+4)], more preferably between +1 to +3 compared with the pH point at the beginning when the dispersed materials are deposited at the cathode. When the dispersed materials are deposited at the anode, the pH value is set between −4 to 0 compared with the pH point at the beginning of the deposition, more preferably −3 to −1 compared with the pH point at the beginning, by which a high deposition film forming efficiency can be kept. If the pH is set departing from the range, there are disadvantages that the dispersion stability of the dispersion can not be obtained and coloring material fine particles are deposited on non-image area and that the variation of the amount of deposition will occur. If the pH is set departing from the preferable range, the deposition film forming efficiency is lowered, the deposition potential is increased, and problems will occur on the film characteristics of the formed film.

After prepared the dispersion of the coloring material fine particles, an image holding element which can function as one of electrodes pair and have surface for holding image and an opposite electrode which is the other of the electrodes pair in the dispersion. This is used in the following step as an image forming device.

The image holding element is not specially limited in its shape or material, provided that it exhibits the above function. For examples, as the materials, a backing having conductivity such as metal, organic semiconductor, inorganic semiconductor and an insulating substrate on which these are deposited etc., may be used. In particular, rare metals such as platinum and gold and carbon are preferable because these are excellent in electrochemical stability. The transparent electrode such as ITO or conductive polymer formed on the transparent backing such as glass or transparent film can also be used as an image holding element.

The important factors for obtaining the excellent printing properties is that the image holding element has a surface, on which an image is formed, being smooth and having no difference in level, and important factors for obtaining excellent transfer properties is that the image holding element has a low surface energy. These factors become important properties when the image holding element is used repeatedly, from the view of the cleaning properties of the image holding element.

Concretely, an excellent transfer property can be obtained when the surface roughness (Ra) of the surface of the image holding element is in the range from 0.01 $\mu$m to 1.5 $\mu$m, more preferably from 0.06 $\mu$m to 0.6 $\mu$m. If the surface roughness of the surface of the image holding element is high, the adhesive force of the surface of the image holding element and the coloring material adhering to it and forming an image will increase due to the increase of the contacting surface area and the physical anchoring effect, and the transfer property of the image coloring material will be decreased. Thus the surface of the image holding element must be smooth, having Ra of 1.5 $\mu$m or less. However, if the smoothness is excessive (Ra: less than 0.01 $\mu$m) and the surface is mirror-smooth, the gross of the image surface of the transferred image will be too high so that the surface is glaring, and visual problems will occur.

In addition, if the critical surface tension of the surface of the image holding element is 30 dyne/cm or less, more preferably in the range from 14 dyne/cm to 26 dyne/cm, more excellent transfer properties will be obtained. The critical surface tension of the surface of the image holding element is thus lowered, the adhesive force of the image coloring material and the surface of the image holding element will be lowered physically, and a high effect on the improvement of the transfer failure at the time of transfer and the ununiformity of the transfer can be obtained.

By these properties, not only a high image quality of the transferred image can be kept, but also the physical cleaning property for the residues of the image on the image holding element will be increased. A printing cycle producing a high image quality can be constituted as a system by which histories of the previous recording image informations are not always remained even if deposition recordings of the different images are carried out every time.

As a useful means for lowering surface energy, there is a method for forming a low surface energy layer on the surface of the image holding element. As the material for the low surface energy layer, e.g., fluorine resins, fluorine rubber (FEP), dimethyl siloxane resins, silicone rubber, and a composite materials obtained by mixing conductive powders into these materials in order to control the electric resistivity of the layer itself, may be exemplified.

The layer thickness of the low surface energy is generally 10 $\mu$m or less, preferably from 0.2 to 3.0 $\mu$m. If the layer thickness is more than 10 $\mu$m, the printing voltage will be increased due to the decrease of the electric conductance, the printing image will be deteriorated due to the diffusion of the electric current, the thermal transfer loss is increased due to the increase of the distance from the heating element (which will be described) to the heated subject, and thus the energy efficiency will be decreased.

In order to improve the effect of inhibiting offset of the electrodeposited coloring material image, treatments such as application of a small amount of anti-adhesion agent for coloring material such as silicone oil and Teflon powders and of lubricant.

The shapes and materials of the image holding element are not limited, provided that the surface roughness (Ra) and/or the critical surface tension can be set as described above, by any method such as utilization of the above low surface energy layer. For example, as the material, a substrate having conductivity such as metal, organic semiconductor and inorganic semiconductor, and an insulating substrate on which these materials are deposited, may be used. In particular, rare metals such as platinum and gold and carbon are preferable due to their excellent electrochemical stability. A transparent electrode such as ITO and a conductive polymer formed on a transparent substrate such as glass and a transparent film, may be used as an image holding element.

Further, it may be an image forming element having a backing having a conductive surface and a photoconductive material (typically PN conjugation or PIN conjugation) formed on the conductive surface. In the element, electromotive force is produced on the irradiation area by optical irradiation. As described later, the element has a structure in which an electric current is applied to the optical irradiation area of the image holding element and the electrodeposition phenomenon of the dispersed particles is occurred and optical lettering is possible. The whole of the backing may have a conductivity, and only the surface of the backing may have a conductivity.

The main structure of the image holding element has a basic structure comprising backing, transparent conductive layer, photoconductive material layer. When the backing of the image holding material has a permeability to the image input light, the permeability is preferably 40% or more, more preferably 60% or more to the specific wavelength of the input light. If the permeability to the image input light is lower than it, the input efficiency of the light image signal from the substrate will be lowered, and a sufficient quality can not be obtained in forming an image.

The materials forming the above PN conjugation and PIN conjugation are not limited, provided that it is a material having electromotive force (photoconductive material) in which p type semiconductor and a type semiconductor are conjugated and the p type semiconductor and the n type semiconductor are conjugated via an insulating layer. Each of the material may be organic or inorganic material. Typically as the inorganic photoconductive materials, Si, Ge, GaAs, CdSe, CdS, CdTe, InP, AlSb, GaP may be exemplified. Further as the organic photoconductive materials, a variety of materials may be used such as phthalocyanines having various center metals, porphyrins, naphthalocyanines (p type), perylene, perylene derivatives (n type) such as perylene tetra carboxylic acid diimide, benzimidazole perylene, polyvinyl carbazole [PVK] (p type), quinacridones (p type), polyphenylene vinylene [ppv] (n type).

For the insulating layer, a non-doped semiconductor is generally used.

The PIN conjugation of amorphous silicone has preferably a film thickness of about 10 to 50 nm in case of n type, about 500 to 1000 nm in case of i type, about 10 to 50 nm in case of p type. The organic PN conjugation has preferably a film thickness of about 20 to 100 nm of P layer and N layer, respectively, since the conductivity is low and absorption property is large.

The image holding element having a highly smooth surface on which an image is formed and having no difference in level, can provide a good printing characteristics. In particular, the characteristics become important when the image holding element is used repeatedly. By the characteristics, the physical cleaning properties of images on the surface of the image holding element become high, and a printing cycle by which the previous history of the recording image information is never remained can be constructed, even if the particle deposition recording of different images are carried out every time.

The opposite electrode which is the other of the electrodes pair is not limited in its materials and shapes. For example, the material can be selected from the materials which are used frequently in the electrochemical field such as Pt, Au, SUS, carbon etc.

The above image holding element and opposite electrode are immersed in the dispersion of the coloring material fine particles. The "immersion" used in the present invention includes the immersion of at least a part of the subject into a liquid and the contact of at least a part of the subject with a liquid.

The image holding element and the opposite electrode have a means for flowing electric current between them. Therefore, a lead in which electric current flows in usage is directly connected to the image holding element. Alternatively, the above-mentioned auxiliary electrode (cooperation electrode) is contacted or arranged, through which a lead is connected. However, the image holding element may have a structure in which a lead is not connected to the image holding element and the cooperation electrode is made needle or pen-like etc. and the image holding element is capable of functioning as an electrode when the cooperation electrode is contacted to the element.

It is preferable in the actual uses to use three-pole electrode system having a control electrode besides the above electrodes in view of the stability of the voltage between the image holding element and the opposite electrode.

After preparing the above device, an electric current is applied to the desired area of the image holding element and the opposite electrode through the dispersion, by which the coloring material fine particles are deposited electrochemically to the desired area and an image is formed. The reason is that the coloring material fine particles can be deposited to the anode by making the image holding element function as an anode if the coloring material fine particles are ionized at the positive side; and the coloring material fine particles can be deposited to the cathode by making the image holding element function as an cathode if the coloring material fine particles are ionized at the negative side.

In order to applying electric current between the image holding element and the opposite electrode, external power source may be utilized generally. In this case, an image of a desired pattern can be drawn, since only the area of the image holding element around the lower part of the cooperation electrode functions as an electrode by scanning the above needle or pen-like cooperation electrode against the image holding element, if the resistance value of the image holding element is not much lowered (e.g., less than 1 kΩ). In this case, the image holding element has a structure having a conductive layer by which electric current is not diffused and outputted from the area holding an image when electric current is inputted from the reverse.

When the image holding element utilizes the phtoconductive material, the above application of electric current can be carried out by utilizing the irradiation of light and the application of bias voltage. In this case, an image of a desired pattern can be drawn even by image-like exposure and scanning of irradiation light. such as laser.

Examples of the devices carrying out the steps will be schematically shown in FIGS. 3 to 6.

Figure 3:
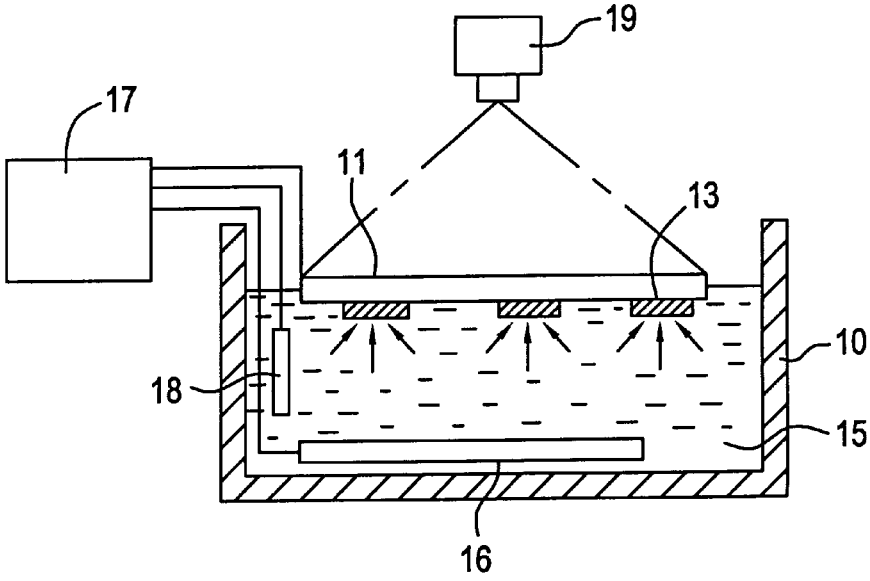
FIG. 3 shows schematically an example of the device carrying out the method of the present invention.

With the device shown in FIG. 3, the dispersion 15 is filled in the vessel 10, the opposite electrode 16, the image holding element 11, and the control electrode 18 (immersed in the dispersion) electrically connected to the potentiostat power source 17 are utilized (it is the same in the devices shown in another Figures). The potential electrode 16 is sunken horizontally in the dispersion 15, and the image holding element 11 is made horizontal, and the area for holding the image is contacted to the level of the dispersion. The image-like exposing device 19 is arranged over the image holding element 11.

The image holding element used in the present invention, as described above, has a (photo) conductive layer on a substrate, but a structure which further has a heating layer (heating element) can be used preferably.

The heating layer is a layer which generates heat when electric current is applied, and when an image is transferred from the image holding element to a transfer medium, heat is generated on the transferred area, and the coloring material forming image was melted to facilitate the transfer of an image.

Thus in order to apply electric current to the corresponding area to the transfer of the heating layer, it is preferable to arrange a pattern conductive layer capable of it and a return conductive layer. Namely, in order to produce a heat locally in the heating layer, it is preferable to arrange a pattern current application layer which addresses input current applied in the heating layer (a layer functioning as an addressing input electrode layer), from which a current is inputted into the heating layer, and a return conductive layer which becomes a return of the current which heated the heating layer. In this case, the above heating layer is positioned between the above pattern conductive layer and the return-conductive layer, and generates Joule heat in the input area locally by the input current which was addressing inputted between them.

The pattern conductive layer, the return conductive layer and the heating layer may be laminated on the backings, in the order of the pattern conductive layer, the heating layer and the return conductive layer, and in the order of the return conductive layer, the heating layer and the pattern conductive layer.

When light is irradiated to the photoconductive layer through the heating layer, the heating element has preferably 40% or more of permeability. If the permeability to the image input light is lower than it, the input efficiency of the light image signals will be decreases and a sufficient quality for forming images can not be obtained.

Figure 8:
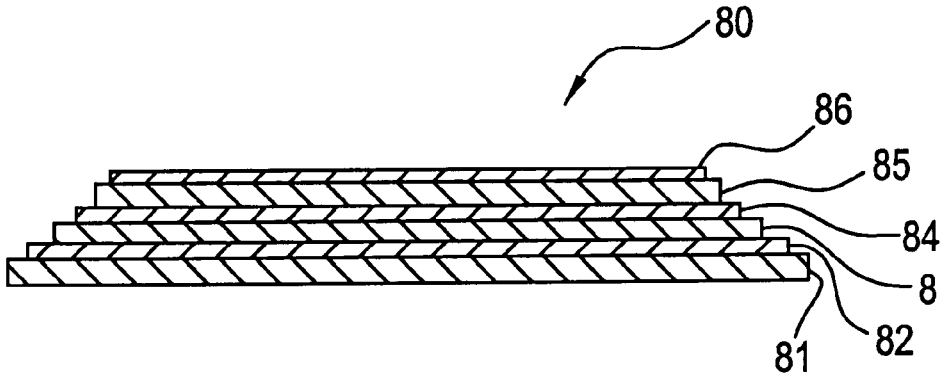
FIG. 8 shows a schematic cross-sectional view of an example of the image holding element having a heating element layer.

A cross-sectional view of one example of the image holding element is shown in FIG. 8. The image holding element 80 has a structure in which the transparent pattern conductive layer 82, the transparent heating layer 83, the transparent return conductive layer 84, the photoconductive layer 85, the low surface energy layer 86 were formed in this order on the substrate 81.

Figure 9:
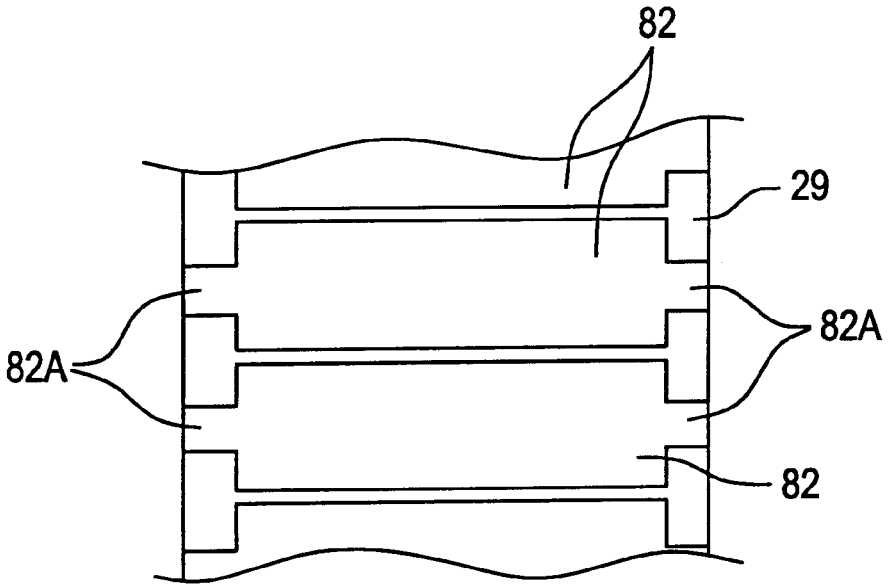
FIG. 9 shows a pattern of the pattern conductive layer in the image holding element.

The pattern conductive layer 82 is to be an electrode separated and isolated into a shape convenient to the above addressing, such as strip or linear similar to the heating layer shape or combination thereof, and a variety of shapes. For example, the pattern of the pattern conductive layer 82 is made as shown in FIG. 9. Namely, the pattern conductive layer 82 is divided and arranged, and one or both (both in FIG. 8) of the side edges of each pattern conductive layer are exposed to one or both of the side edges of the heating layer, and the exposure area 82A is to be a current input area for receiving the input current. Thus the heating layer can be heated locally.

At least one or both of the side edges of the above return conductive layer are exposed to one or both of the side edges of the heating element as the pattern conductive layer, and the exposure area constitutes a current output area for return path of the current inputted from the above pattern conductive layer.

Figure 7:
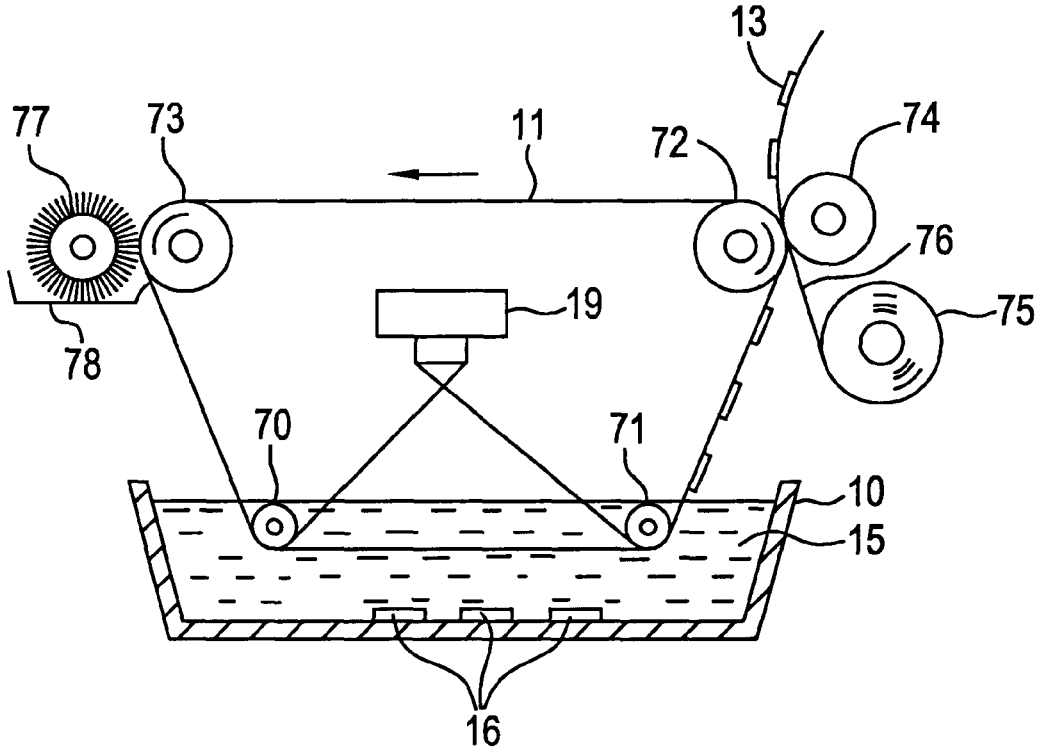
FIG. 7 shows schematically an example of the device continuously carrying out the method of the present invention.

From the current in-output area formed on one or both of the side edges of the heating layer of the image holding element formed as described above, a power supply system which supply current to the heating layer between the pattern conductive layer and the return conductive layer selectively, is incorporated into e.g., the roller 72, the transfer roller 74 and the like as shown in FIG. 7. In other words, a dynamic or static electric contact such as a roller-shaped dynamic electric contact and a tongue-shaped static electric contact is arranged in the position corresponding to the exposing area at the side of the pattern conductive layer of the image holding element. On the other hand, the same roller-shaped dynamic electric contact and tongue-shaped static-electric contact and the like as described above are incorporated in the position holding the image holding element (namely, in the suitable position at the side of the return conductive layer exposing to the side edge of the heating element, preferably in the position where the dynamic or static electric contact are opposed each other at the side of the pattern conductive layer side). The transfer is preferably carried out using the heating transfer unit in which a power supply system is incorporated or the heating and pressuring transfer unit.

As the input current which is applied to the return conductive layer via a heating layer from the pattern conducive layer via the dynamic or static electric contact and the like, an alternating current or a pulse current or a modified current thereof may be adapted, and the pulse current is preferably used from the viewpoint of the temperature controlling etc.

Thus, in the image holding element having a heating element, a current is applied locally to one area of the pattern conductive layer, the area of the heating layer generates heat locally, and only the necessary area (e.g., only the area where pressured if the image transfer area is heated and pressured) is heated when coloring material image, which is carried on the image recording medium such as paper, is transferred. In this case, the distance of the heating area of the image holding element, i.e., heating layer and the untransferred coloring material image of the image holding element requiring transfer, was made extremely narrow. Further, since the necessary area is generated heat locally and heated, the heat value is low and it generates heat to a high temperature for a moment, and the non-transferred coloring material image can be heated to a high temperature. Besides, since the heat capacity of the heating layer which generates later is small, the temperature decreases and returned to near the room temperature in a short time. Therefore, with the heating phenomenon, the total amount of heating energy can be decreased, and the temperature increase of the whole of the device can be controlled. Even a device such as image transfer unit, in which an image holding element having a heating layer is loaded, a cooling system for controlling the temperature increase of the whole of the device, may be equipped if desired.

Further, since the heat value on the heating area of the image holding element can be controlled easily by forming a thermo-detecting device which detects the temperature of the image holding element having a heating layer and a supply power controlling system which controls the supply power to the heating layer corresponding to the temperature detected by the thermo-detecting device, an excellent transfer image can be obtained and thus the devices are useful.

For examples, when the current contacting area is formed from a plurality of divided electrodes, it is preferable to use a block division circuit which divides the image signal into blocks corresponding to the division electrodes, a setting circuit (pulse width setting circuit and pulse number-timing setting circuit etc.) which sets current energy amount supplied to each division electrode by detecting the image signal from the block. division circuit and the atmospheric temperature, and a driver circuit which produces the heat value for heating based on the output signal from the setting circuit.

The materials for forming the pattern conductive layer, the heating layer and the return electrode layer will be explained hereinafter.

The material for forming the above pattern conductive layer is not limited provided that it has an excellent conductivity. For examples, a thin film such as a spattering film made from metal or conductive ceramic, a vacuum deposition film, a screen printing film made from conductive paste may be used, and it may be patterned into a desired shape by means of e.g., photolithography and screen printing method.

The film thickness of the pattern conductive layer is usually 5 $\mu$m or less, preferably 1 $\mu$m or less. If the film thickness exceeds 5 $\mu$m, the leaked heat value of the pattern conductive layer will be increases, and the heating temperature on the heating layer to the input current will be decreased.

In addition, the above return conductive layer is formed into a thin film shape by a material excellent in conductivity as the pattern conductive layer.

Further, as the return conductive layer, for example, a thin film such as a spattering film made from metal or conductive ceramic, a vacuum deposition film, a screen printing film made from a conductive paste may be used preferably, and the film thickness is usually 5 μm or less, preferably 0.5 μm or less. If the film thickness exceeds 5 μm, the leaked heat value on the electrode area will be increased and the heating temperature of the heating layer to the input current will be decreased.

Further, the above heating layer is selected from the materials having a heat-resistance 200° C. or more usually, preferably 300° C. or more, and having a volume resistivity $10^{-2}$ to $10^{-4}$ Ω·cm usually, preferably from $10^{-1}$ to 10 Ω·cm.

The materials for forming these heating layer, may be usually formed by mixing or chemical bonding each one or several species of the conductive materials such as conductive ceramic materials, conductive carbon materials and metal compounds, and of the insulating materials such as insulating ceramic materials and heat resistant resins. As the conductive materials used here, carbon and metal materials such as C, Ni, Au, Ag, Fe, Al, Ti, Pd, Ta, Cu, Co, Cr, Pt, Mo, Ru, Rh, W, In and chemical compounds such as $VO_2$, $Ru_2O$, TaN, SiC, $ZrO_2$, InO, $Ta_2N$, ZrN, NbN, VN, $TiB_2$, $ZrB_2$, $HfB_2$, $TaB_2$, $MOB_2$, $CrB_2$, $B_4C$, MoB, ZrC, VC, TiC may be exemplified. As the heat resistant resins, polyimide resins, polyalamide resins, polysulfon resins, polyimide amide resins, polyester-imide resins, polyphenylene oxide resins, poly-p-xylylene resins, polybenzimidazol resins, and resins comprising derivatives thereof, and a variety of modified resins may be exemplified. As the insulating material used for controlling resistivity and integrity, ceramic materials such as AlN, $SiN_4$, $Al_2O_3$, MgO, $VO_2$, $SiO_2$, $ZrO_2$, $MO_2$, $Bi_2O_3$, $TiO_2$, $MoO_2$, $WO_2$, $NbO_2$, $ReO_3$ and the above heat resistant resins may be used.

As preferable materials constituting the heating layer, e.g., carbon dispersed polyimide resin, Ni powder dispersed silicone resin, Ta—$SiO_2$ mixed ceramic material and RuO—$SiO_2$ may be exemplified. The film thickness of the heating layer is usually 10 μm or less, preferably in the range from 0.2 to 5 μm. If the film thickness exceeds 10 μm, the problems that the heating efficiency to the input power is lowered and the energy consumption will increase.

If the image holding element is in a shape of belt or drum as shown in FIG. 7, the allowances of controlling pressure between the image holding element and the recording medium and of controlling timing for pealing off the recording medium will be increased, thus the transfer efficiency of images and the uniformity of the transferred image may be increased. As the substrate material at this time, a strip shaped polymers such as polyimide resin and its modified compound, polyalamide resin and its modified compound, or silicone resin and its modified compound or a material containing these polymers as a main component, may be exemplified.

Figure 4:
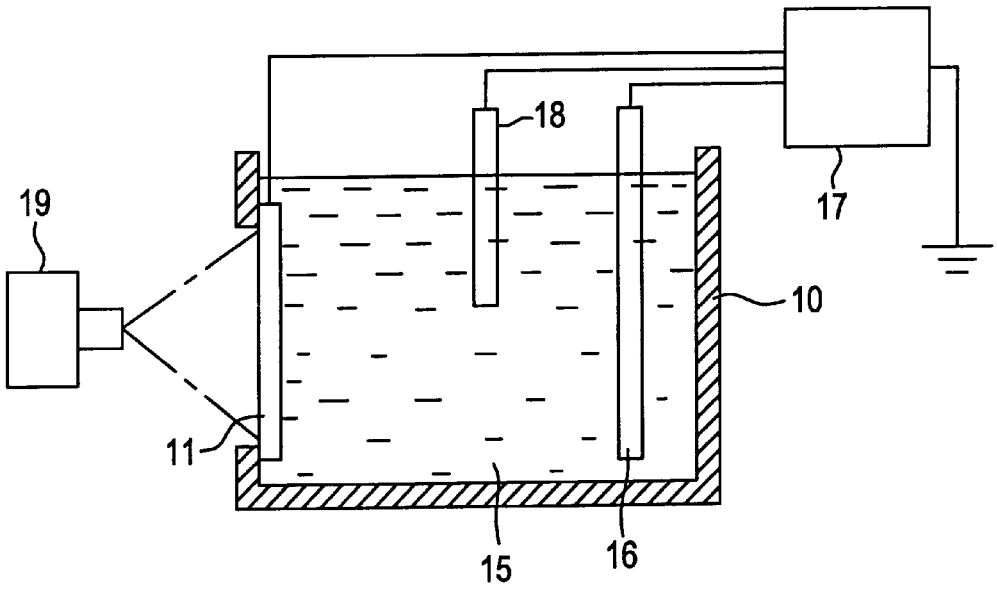
FIG. 4 shows schematically an example of the device carrying out the method of the present invention.

With the device shown in FIG. 4, the vessel 10 having an aperture on the side is used, the image holding element 11 is set closely by a sealing jig (not shown) so as to close the aperture, the opposite electrode 16 is set perpendicularly so as to oppose it, and the lower part of it is immersed in the dispersion 15. In addition, the image-like exposing device 19 is arranged opposite to the image holding element 11.

Figure 5:
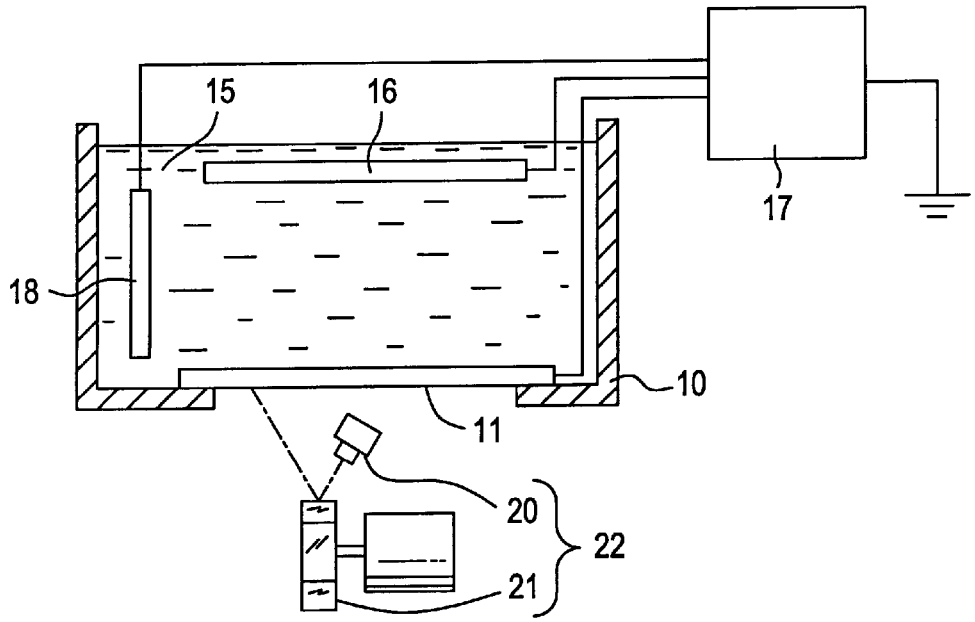
FIG. 5 shows schematically an example of the device carrying out the method of the present invention.

With the device shown in FIG. 5, the vessel 10 having an aperture on the bottom surface is utilized, the image holding element 11 is set closely in order to close the aperture, the opposite electrode 16 is set perpendicularly so as to oppose it and immersed in the dispersion 15. The laser scanning series 22 having the laser light source 20 and the polygonal mirror 21 is arranged, and the laser can be scanned in the desired part of the image holding element 11.

With the above devices, the conductivity of only the desired part of the image holding element 11 is increased by irradiating light image-like or scanning beam-like lights, by which electric current is applied between the desired part and the opposite electrode 16 via the dispersion 15. As the results, the coloring material 13 is deposited to the desired part of the image holding element and an image is formed.

Figure 6:
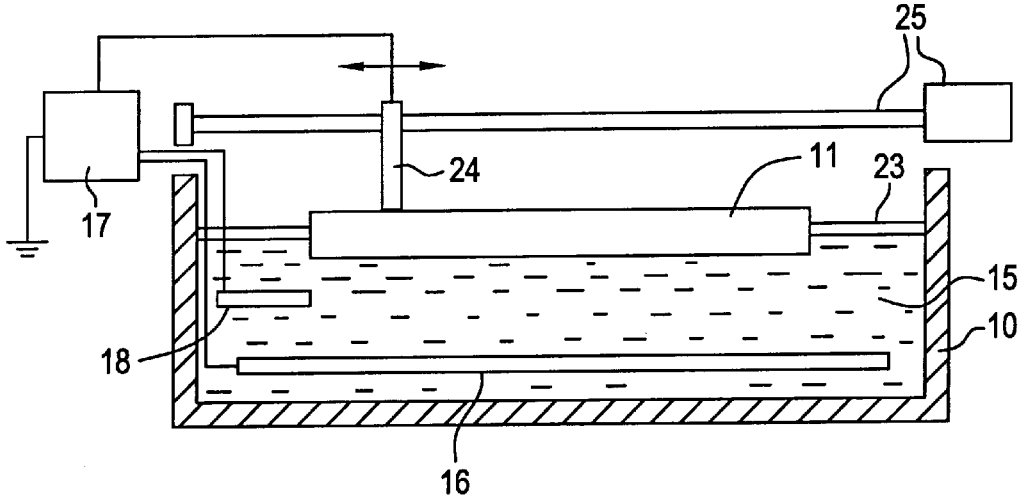
FIG. 6 shows schematically an example of the device carrying out the method of the present invention.

With the device shown in FIG. 6, the opposite electrode 16 is set perpendicularly near the bottom of the vessel 10, and immersed in the dispersion 15. The image holding element 11 is fixed by the fixing jig 23 for image holding element so that the surface of the image holding side is contacted with the liquid level of the dispersion 15. The needle-like cooperation electrode as the image input printing head 24 is arranged so that it can be contacted with the reverse of the image holding element 11 and can be scanned by the printing head scanning series 25.

With the device, the image input printing head 24 is scanned by the printing head scanning series 25, it is contacted with the image holding element 11 when desired, and an electric current is supplied between the contacting part of the image holding element 11 and the opposite electrode 16. As the results, the coloring material 13 is deposited on the contacting area of the reverse of the image holding element 11 to form an image.

As described above, an electric current is supplied or an electric field is formed corresponding to the image pattern on the image holding element 11 and the coloring material is deposited on the part so as to form an image.

The conditions of the image forming (particle deposition) process will be shown concretely hereinafter.

The difference of the voltages applied between the image holding element and the opposite electrode in this process is usually less than 15 V using bias voltage. However, in order to reproduce every one picture element sharply on an image, signal input on a direct current pulse having a short-time width and short pulse thereof on the piles of pulse. The difference of the voltages applied between the both electrodes is preferably less than 10 V, and more preferably 5 V or less if better film properties of coloring material is required. If the voltage difference more than 10 V is applied, the production of foams by electrolysis of the dispersion from the electrode surface becomes vigorous, the distribution of the electric field on the surface of the electrode becomes uniform, the film properties of the deposition film itself becomes uniform, the surface of the deposition film becomes rough, and the reproduction of an image having fine patterns becomes difficult.

In the well-known electrodeposition coating, an electrodeposition is carried out by providing applied voltage of 50 V or more. Since if the applied voltage is low, the resistance of the formed electrodeposition film is high, and as the formation of the electrodeposition film proceeds, the rate of the electrodeposition film formation is highly decreased, and a desired film thickness can not obtained. In order to inhibit the problem, a high voltage application is carried out and a vigor foaming phenomenon by electrolysis is caused. A required film thickness (generally 10 μm or more) as electrodeposition coating by stirring near the electrode surface utilizing the phenomenon and by contacting the electrode surface with the new electrodeposition liquid. However, since the object of the method of the present invention is to reproduce a high quality image and it is preferable that fine image patterns having a film thickness of 1 μm or less level can be reproduced, the foaming phenomenon by the electrolysis of the dispersion must be continuously controlled, and the phenomenon must be controlled to the level which does not influence on the fine image pattern reproduction even if it is produced. Thus the applied voltage difference is less than 10 V, and 5 V or less when image quality is more required.

In order to keep the uniformity of the liquid characters of the dispersion bath, the uniform deposition film can be more easily formed by carrying out a stirring in the dispersion bath. However, if the stirring is too strong, the formation of the deposition film is slowed, and the scatter of the dispersion is produced, so that it must be inhibited.

Further, a more uniform and good film properties can be obtained by controlling the temperature of the dispersion. It can be recommended to equip a liquid temperature controlling system having a high precision, especially when the high quality image is reproduced.

With the above-described method, as to the image patterns formed on the image holding element, the image holding element can be handled directly as a document, or the image may be transferred to another media to be used as a document (the transfer will be explained concretely later).

Then, the above described dispersant and the like will be explained. The dispersant is hydrophilic and has an existence of a molecular structure having a group which is easily dissociated in an aqueous liquid, in order to exhibit its functions (dispersing functions of coloring material fine particles). When an electric current or electric field is supplied to the dispersion, pH of the dispersion extremely near the current supplied area of the image forming area of the image holding element is changed, the electric double-layer formed by the dispersion containing particles near the current supplied area of the image holding element is compressed, and the color material fine particles are coagulated to cause a deposition phenomenon.

When the image area (image pattern area) is more electrically cathodic than the opposite electrode, one or more materials having one or more anion groups represented by the following structure may be used as a dispersant. By the bonding, adhesion or association of these materials on the surface of the coloring material fine particles, a preferable deposition phenomenon is occurred and a coloring materials deposition film as an image having an extremely high quality is obtained. In particular, a material having a carboxyl group as the anion group exemplary defined by formula (I), has a high efficiency of the deposition of the coloring material fine particles on the deposition phenomenon and shows better characteristics.

(1)

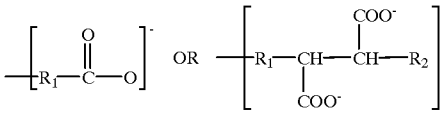

$R_1$, $R_2$=hydrocarbon group

When the image area of the image holding element is more electrically anodic than the opposite electrode, one or more materials having one or more cation groups represented by the following structure (2)may be used as a dispersant. By the bonding, adhesion or association of these materials on the surface of the coloring material fine particles, a preferable deposition phenomenon is occurred, and a coloring materials deposition film as an image having an extremely quality is obtained.

(2)

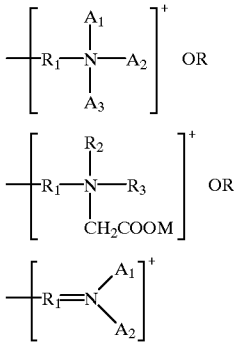

$R_1$, $R_2$, $R_3$=hydrocarbon group $A_1$, $A_2$, $A_3$=H, alkyl group, aryl group or the like M=H, a variety of metal ion, hydrocarbon or the like.

Among them, a surfactant, a water-soluble macromolecular compound and a macromolecular compound having a low degree of polymerization having the above ionic substituent group, show very preferable characteristics in view of the dispersing stability and the film characters of the deposition film. As examples of the dispersants having water-soluble macromolecular compound and having macromolecular compound having low degree of polymerization, alkyl alkylene oxide carboxylate, alkyl oxide carboxylate, alginic acid modified carboxylate, carboxyl modified methyl cellulose, polyacrylic acid modified carboxylate, polymethacrylic acid modified carboxylate, polyethylene oxide modified carboxylate, epoxy modified carboxylate, polyethanol amine modified methyl cellulose, amine modified alginate, amine modified polyacryl and the like may be exemplified.

The above-mentioned humectants are added for the purpose of inhibiting change of properties of the dispersion by the evaporation of the aqueous solvent components. As the characteristics and shapes, a liquid which is highly hydrophilic and which has an azeotropic point with water, a high boiling point and a low vapor pressure is preferable. As the necessary characteristics, it is a solvent having a high polarity, preferably having a melting point of 120° C. or more and a saturated vapor pressure of 100 mmHg or less at room temperature in an atmosphere, more preferably having a melting point of 150° C. or more and a saturated vapor pressure of 60 mmHg or less. If departing from the ranges, the life of the dispersion becomes short, the change of the characteristics of the dispersion becomes large, and a stable deposition characteristics can not be easily obtained. The percentage composition is preferably in the range from 0.5 wt % to 70 wt % in the liquid component of the dispersion, and more preferably in the range from 5 wt % to 30 wt %. The representative concrete examples of them is ethylene glycol, diethylene glycol, polyethylene glycol, glycerine, triethanol amine, methyl cellosolve, ethyl cellosolve, butyl cellosolve, ethylene glycol diacetate and the like.

The additions of water-soluble macromolecular additives, electrolytic polymerization materials, and (except dispersion of the coloring material fine particles) emulsion materials provide a stable film forming characteristics at the time of particle deposition by depositing them as a part of the image at the time of image formation, and show a high effect on the improvement of the film characteristics of the deposition film, and the fastness properties of the deposited image and the electric resistance control of the film. The amounts of the additives are preferably in the range from 0.2 wt % to 50 wt %, more preferably in the range from 1 wt % to 15 wt % as a content of the solid contents.

As the water-soluble macromolecular additives, gelatin, gumarabic, pectin, casein, starches, microcrystalline cellulose, alginate, polyvinyl alcohol, vinyl acetate copolymer, polyacrylic acid copolymer, methyl cellulose derivatives may be exemplified as representative examples.

As the electrolytic polymerization materials, pyrrole, phenylene, diacetylene, aniline, thiophene and derivatives thereof may be exemplified as representative examples.

As the emulsion materials, polyvinyl acetate emulsion, vinyl acetate polymer emulsion, acrylic acid ester copolymer emulsion, synthetic rubber latex and the like may be exemplified as representative examples.

Further, preservatives·mildewproofing agent, a very small amount of surfactants, pH adjustors and liquid viscosity modifier and the like may be added if necessary. In particular, since aqueous liquids are easily deteriorated with the reproduction of microorganisms and the production of molds, the additions of preservatives mildewproofing agent are most preferable.

Then, the method of transferring an image formed on the image holding element to another medium will be explained. The transfer comprising transferring the image which is formed on the image holding element by a deposition phenomenon from the image holding element using electrostatic force, pressure, adhesive power, chemical bonding force and the like onto a transfer medium such as normal paper so as to form an image. The concrete method, e.g., may comprise contacting a transfer medium with the image holding surface of the image holding element and pressure welding with a pressure roller.

The image holding element on which an image is formed can be used as a master (negative for printing) for the formation of reproduced images. For example, an image can be reproduced by applying a water-soluble color matter on the whole surface of the image holding body on which an oil-soluble image is formed, then adhering a water-soluble color matter only onto a non-image part via a step of applying a water-soluble color matter, and transferring the water-soluble color matter to another record medium.

The method of the present invention can be carried out continuously by using the device, for example shown in FIG. 7 schematically.

In the apparatus, the opposite electrode 16 is arranged in the inner bottom of the vessel 10 containing dispersion 15. In the dispersion 15, the two rollers 70 and 71 are arranged at intervals, and the two rollers 72 and 73 are arranged in parallel with and upper of the pair of the rollers 70 and 71. The belt-like image holding element 11 is wound the four rollers, so that the element 11 can rotate around. The image holding image 11 has a structure in which photo-conductive materials are laminated on a transparent backing through a transparent electrode. A transfer roller 74 is pressure welded to the one of the upper roller 72, and between which the paper 76 can be carried from the paper role 75. The cleaning brush 77 is contacted with the other of the upper roller 73, and under which the cleaning waste disposal dish 78 is provided. Further, the image-like exposing device 19 is arranged in around center of the belt formed by the image holding element 11 so that the device 19 can irradiate light toward the lower direction.

In the apparatus, when applying voltage between the image holding element 11 and the opposite electrodes 16 by a power source (not shown) with exposing by image-like exposing device 19, an image of the coloring material 13 is formed on the image holding element 11. Then when the image holding element 11 is rotated around, the image is transferred on the paper 76 with the transferring roller 74. Further, the image holding element 11 is rotated around, unnecessary coloring material particles remained on the element holding material 11 are removed by a cleaning brush 77, and the part of the image holding element 11 is returned to the condition which can be provided for the formation of an image again.

As the method of removing the coloring material particles on the surface of the image holding element 11, cleaning methods such as blade method, fur brush method, resilient roller method, cleaning web method and air knife method may be used.

EXAMPLES

The present invention will be explained in more concretely with Examples.

Example 1

10 parts by weight of carbon black (coloring material) powder (average particle diameter: 0.1 $\mu$m), 15 parts by weight of diethylene glycol (humectant), 3 parts by weights of polyoxyethylene alkyl ether sodium carboxylate (dispersant), 3 parts by weight of polyethylene glycol sodium dicarboxylate (dispersant) 6 parts by weight of water-soluble acrylic resin (additive), 7 parts by weight of isopropanol (solvent) and 55 parts by weight of distilled water are mixed and medium degree of stirring using propeller was carried out for one hour to wet the carbon black powders sufficiently in liquid to form a crude dispersion. Then high degree of forced-dispersing treatment of the dispersion was carried out using a homogenizer dispersing device for three minutes to prepare a dispersion stock liquid. A diluent in which 120 parts by weight of distilled water, 10 parts by weight of glycerin, 0.8 parts by weight of mildewproofing agent (Prokycell XL-2, ICI) were mixed, was added dropwise into the dispersion stock liquid with stirring using propeller to prepare a dispersion of coloring material fine particles. The pH of the liquid was adjusted to 6.5 with aqueous phosphoric acid solution and aqueous sodium hydroxide solution. The pH of the liquid at the beginning of the deposition of the coloring material fine particles was 5.0. In addition, the volume resistivity of the liquid was $8\times10^2$ $\Omega\cdot$cm.

Then, as shown in FIG. 3, an image holding element which can be inputted image signal from the reverse and which functions as an electrode, was set in the dispersion bath filled with the above described dispersion so that its reverse surface is positioned exterior of the dispersion bath, and an opposite electrode and a control electrode using salt bridge are arranged in the bath. The image holding element was formed by providing an ITO transparent conductive layer on a plate glass substrate having a thickness of 4 mm and forming a laminate structure of two-layered organic photoconductive layer (two-layered structure comprising each pigment having a thickness of 50 nm of phthalocyanine and perylene) on the transparent conductive layer. The ITO photoconductive layer was used as a work electrode (which means a part where a voltage is applied directly from the exterior of the image holding element functioning as electrode). The surface of the organic photoconductive layer had no difference in level and was smooth. Each electrode was connected to potentiostat power source. Then with inputting an image to the photo-image input area of the reverse of the image holding element, D.C. voltage of 3.0 V was applied between the work electrode and the opposite electrode for 15 seconds from the potentiostat power source.

Then, the image holding element was picked up from the liquid after completing the image formation, and it was confirmed that a high quality image having a optical image density of 1.41 was formed on the surface of the image-holding element.

Example 2

20 parts by weight of carbon black powders (average particle diameter: 0.07 μm), 10 parts by weight of polyethylene glycol, 5 parts by weight of polymethyl acrylate ammonium dicarboxylate, 5 parts by weight of polyqxyethylene alkyl phenyl ammonium carboxylate, 6 parts by weight of water-soluble acrylic resin, 10 parts by weight of isopropanol and 50 parts by weight of distilled water were mixed, and a medium degree of stirring using a propeller was carried out for three hours to wet the carbon black powders sufficiently in the liquid to form a crude dispersion. Then a dispersing treatment of the dispersion was carried out using a ball mill dispersing device for 24 hours to form a dispersion stock liquid. A diluent in which 200 parts by weight of distilled water, 20 parts by weight of glycerine, 0.5 parts by weight of mildewproofing agent (Prokycell XL-2, ICI) were mixed, was added dropwise in the dispersion stock liquid with stirring using a propeller to form a dispersion of coloring material fine particles. The pH of the liquid was adjusted with aqueous phosphoric acid solution and aqueous ammonium solution to 6.0. The pH of the liquid at the beginning of the deposition of the coloring material fine particles 5.0. The volume resistivity of the liquid was $2\times10^2$ Ω·cm.

Then, using the same device as in Example 1 as shown in FIG. 3, an image holding element equipped with a work electrode which can be inputted image signal from the reverse was placed in the dispersion bath filled with the above described dispersion so that its reverse surface is positioned exterior of the dispersion bath, and an opposite electrode and control electrode using salt bridge were arranged in the bath. The image holding element was formed by providing a transparent conductive layer on a quarts substrate having a thickness of 2 mm and forming a two-layered organic photoconductive layer (as described above) on the transparent conductive layer. The ITO photoconductive layer was used as a work electrode, and the organic photoconductive layer was smooth. Each electrode was connected to a potentiostat power source. Then with inputting images to the photo-image input area of the reverse of the image holding element by He—Ne laser light, D.C. pulse voltage of 5.0 V (pulse width 2 ms/pulse period 3 ms) was energized between the work electrode and the opposite electrode.

Then, the image holding element was picked up from the liquid after completing the image formation, and it was confirmed that the a high quality image having a optical image density of 1.52 was formed on the surface of the image holding element.

Example 3

10 parts by weight of phthalocyanine powders (average particle diameter: 0.2 μm), 10 parts by weight of ethyl cellosolve, 7 parts by weight of polyoxyethylene alkyl phenyl lithium acetate, 4 parts by weight of polymethyl acrylate lithium dicarboxylate, 6 parts by weight of water-soluble acrylic resin, 10 parts by weight of isopropanol and 50 parts by weight of distilled water were mixed, and a medium degree of stirring using propeller was carried out for a half hour to wet the pigment powders sufficiently in the liquid to prepare a crude dispersion.

Then, a dispersing treatment of the dispersion was carried out using a homogenizer dispersing device for four minutes to prepare a dispersion stock liquid. A diluent in which 200 parts by weight of distilled water, 20 parts by weight of diethylene glycol and 0.5 parts by weight of mildewproofing agent (Prokycell XL-2, ICI) were mixed, was added dropwise into the dispersion stock liquid with stirring using a propeller to prepare a dispersion of coloring material fine particles for electrodeposition. The pH of the liquid was adjusted with an aqueous phosphoric acid solution and aqueous lithium hydroxide solution to 7.0. The pH of the liquid at the beginning of the deposition of the coloring material fine particles was 4.0. The volume resistivity of the liquid was $9\times10^2$ Ω·cm.

Then, using the device shown in FIG. 6, an image holding element which can be inputted image signal from reverse, was placed in the dispersion bath filled with the above described dispersion so that its reverse surface is positioned exterior of the dispersion bath, and an opposite electrode and a control electrode using salt bridge were arranged in the bath. The image holding element provided a conductive layer having a thickness of 5 mm and controlling the current diffusion, and the surface of the conductive layer contacting the liquid was smooth.

Then, each electrode was connected to the control power source, image was inputted to the image input area of the reverse of the image holding element using a needle-type cooperation electrode image input printing head of 600DPI, and 4.0 V of D.C. pulse voltage (pulse width 2 ms/pulse period 3 ms) was energized between the needle-type cooperation electrode and the opposite electrode with synchronizing with the scanning rate of the printing head.

Then, the image holding element was picked up from the liquid after completing the image formation, and it was confirmed that a high quality image having a optical image density of 1.10 and having cyanogen color was formed on the surface of the image holding element. In addition, with printing using 2.5 V of D.C.pulse between the needle-type cooperation electrode the opposite electrode, it was confirmed that a high quality image having an optical image density of 1.10 and having cyanogen color was formed on the surface of the image holding element.

Example 4

20 parts by weight of carbon black powders (average particle diameter: 0.07 μm), 10 parts by weight of polyethylene glycol, 5 parts by weight of polymethyl acrylate ammonium dicarboxylate, 5 parts by weight of polyoxyethylene alkyl phenyl ammonium carboxylate, 6 parts by weight of water-soluble acrylic resin, 10 parts by weight of isopropanol and 50 parts by weight of distilled water were mixed and a medium degree of stirring using a propeller was carried out for three hours to wet the carbon black powders sufficiently ion the liquid to prepare a crude dispersion.

Then, a dispersing treatment of the dispersion was carried out using a ball mill dispersing device for 24 hours to prepare a dispersion stock liquid. A diluent in which 200 parts by weight of distilled water, 20 parts by weight of glycerin, 4 parts by weight of pyrrole and 0.5 parts by weight of mildewproofing agent (Prokycell XL-2, ICI) were mixed, was added dropwise into the dispersion stock solution with stirring using a propeller to prepare a dispersion of coloring material fine particles. The pH of the liquid was adjusted by an aqueous phosphoric acid solution and aqueous ammonia solution to 6.0. The pH of the liquid at the beginning of the deposition of the coloring material fine particles was 5.0, and the volume resistivity of the liquid was $1\times10^2$ Ω·cm.

Then, using the same device as in Example 1 shown in FIG. 3, an image holding element which can be inputted image signals from the reverse and which functions as an electrode, was placed in the dispersion bath filled with the above described dispersion so that its reverse surface is positioned exterior of the dispersion bath, and an opposite electrode and control electrode using salt bridge were arranged in the bath. The image holding element was formed by providing an ITO transparent conductive layer on a quarts substrate having a thickness of 2 mm and forming a laminate structure comprising two-layered organic photoconductive layer (as described above) on the transparent conductive layer. The ITO photoconductive layer was used as a work electrode, and the organic photoconductive layer was smooth. Each electrode was connected to a potentiostat power source. Then with inputting images to the photo-image input area of the reverse of the image holding element by He—Ne laser light, D.C. pulse voltage of 1.0 V was energized between the work electrode and the opposite electrode from the potentiostat power source.

Then, the image holding element was picked up from the liquid after completing the image formation, and it was confirmed that a high quality image having a optical image density of 1.26 was formed on the surface of the image holding element.

Example 5 (Transfer)

In the same manner as described in Example 1, a dispersion of coloring material fine particles was prepared, and via a record printing process, the image holding element was picked up from the dispersion bath to obtain an image of the dispersed coloring material fine particles on the image holding element. A normal paper was placed on the image holding material. Corona discharge of +6 KV was carried out from the above of the paper, and the normal paper and the image holding element were held by a pair of rubber rollers at a linear pressure of 600 g/cm to apply a pressure to carry them by rolling. Then the normal paper was pealed off from the image holding element immediately after the application of pressure, so that a transferred image having an optical image density of 1.33 was obtained.

Example 6 (Addition of Aqueous Emulsion Solution)

15 parts by weight of carbon black powders (average particle diameter: 0.1 μm), 15 parts by weight of glycerin, 5 parts by weight of polyoxyethylene alkyl ether sodium carboxylate, 3 parts by weight of polyethylene glycol sodium dicarboxylate, 3 parts by weight of water-soluble acrylic resin, 7 parts by weight of isopropanol and 55 parts by weight of distilled water were mixed, and a medium degree of stirring was carried out using a propeller for one hour so as to wet the carbon black powders sufficiently in the liquid to prepare a crude dispersion.

Then, a high degree of forced-dispersing treatment of the dispersion was carried out using a homogenizer dispersing device for 3 minutes to prepare a dispersion stock liquid. A diluent in which 100 parts by weight of distilled water, 20 parts by weight of vinyl acetate emulsion water solution, and 0.6 parts by weight of mildewproofing agent (Prokycell XL-2, ICI) were mixed, was added dropwise into the dispersion stock solution with stirring using a propeller to prepare a dispersion of coloring material fine particles. The pH of the liquid was adjusted by an aqueous phosphoric acid solution and aqueous sodium hydroxide solution to 6.9. The pH of the liquid at the beginning of the deposition of the coloring material fine particles was 5.2, and the volume resistivity of the liquid was $5\times10^2$ Ω·cm.

Then, as shown in FIG. 3, an image holding element which was equipped with a work electrode capable of being inputted image signals from the reverse, was placed in the dispersion bath filled with the above described dispersion so that its reverse surface is positioned exterior of the dispersion bath, and an opposite electrode and a control electrode using salt bridge were arranged in the bath. The image holding element was formed by providing an ITO transparent conductive layer on a plate glass substrate having a thickness of 4 mm and forming a laminate structure comprising two-layered organic photoconductive layer (as described above) on the transparent conductive layer. The ITO photoconductive layer was used as a work electrode, and the organic photoconductive layer was smooth. Each electrode was connected to a potentiostat power source. Then with inputting images to the photo-image input area of the reverse of the image holding element, D.C. voltage of 2.5 V was energized between the work electrode and the opposite electrode, from the potentiostat power source.

Then, the image holding element was picked up from the liquid after completing the image formation, and it was confirmed that a high quality image having a optical image density of 1.42 was formed on the surface of the image holding element. Then, as the results of a fixing test by rubbing eraser, the degree of change of the optical density of the printing sample of this example was 0.3, and that of the printing sample of Example 1 was 0.4. From the results, it can be confirmed that the fixing property was improved by the addition of the aqueous emulsion solution.

Example 7 (Influence on the Particle Diameter of the Coloring Material Fine Particles)

Dispersion was prepared as the same manner as described in Example using the four pigments powders, carbon black powders (average particle diameter: 0.1 μm), carbon black powders (average particle diameter: 0.4 μm), carbon black powders (average particle diameter: 0.7 μm) and carbon black powders (average particle diameter: 2.0 μm), and an evaluation test on record printing was carried out.

As the results of the evaluation test on record printing, the optical image densities of the recorded image on the surface of the image holding element using the four dispersion were, 1.42, 1.53, 1.25, 0.76. The dispersion stability of the dispersion of the carbon black powders having an average particle diameter of 2.0 μm was unstable, and settlings were found on the bottom of the test tube for settling evaluation after leaving for two days.

Example 8 (Addition of Humectant)

10 parts by weight of carbon black powders (average particle diameter: 0.1 μm), 3 parts by weight of polyoxyethylene alkyl ether sodium carboxylate, 3 parts by weight of polyethylene glycol sodium dicarboxylate, 6 parts by weight of water-soluble acrylic resin, 7 parts by weight of isopropanol and 70 parts by weight of distilled water were mixed, and a medium degree of stirring was carried out for one hour using a propeller so as to wet the carbon black powders sufficiently in the liquid to prepare a crude dispersion. Then, a high degree of forced-dispersing treatment of the dispersion was carried out using a homogenizer dispersing device for three minutes to prepare a dispersion stock liquid. A diluent in which 140 parts by weight of distilled water and 0.3 parts by weight of mildewproofing agent (XL-2, ICI) were mixed, was added dropwise into the dispersion stock solution with stirring using a propeller to prepare a dispersion of coloring material fine particles.

Then, as shown in FIG. 3, an image holding element equipped with a work electrode capable of being inputted image signals from the reverse, was placed in the dispersion bath filled with the above described dispersion so that its reverse surface is positioned exterior of the dispersion bath, and an opposite electrode and a control electrode using salt bridge were arranged in the bath. Then with inputting images to the photo-image input area of the reverse of the image holding element, 2.5 V of D.C. voltage was energized between the work electrode and the opposite electrode, from the potentiostat power source for 11 seconds.

Then, the image holding element was picked up from the liquid after completing the image formation, and it was confirmed that a high quality image having a optical image density of 1.36 was formed on the surface of the image holding element. Then, the recording device filled with the above dispersion of this example and the similar recording device filled with the dispersion of Example 1 were left for one week as they were. As the results, the liquid level of the recording device of this example fell 25 mm, but the liquid level of the recording device of Example 1 fell only 9 mm. The results showed that the addition of the humectant had an effect on the shelf stability of the liquid.

Example 9 (Pulse Voltage Application)

The same dispersion of coloring material fine particles as described in Example 2, was prepared in the same manner as described in Example 2.

Then, using the same device as described in Example 2 shown in FIG. 3, D.C. pulse voltage of 5.0 V (pulse width 2 ms/pulse period 3 ms) was applied between the work electrode and the opposite electrode from the potentiostat plower source with inputting images to the photo-image input area of the image holding element by He—Ne laser light from the potentiostat power source. At the time, print recording was carried out with stirring the dispersion in the bath slightly using a propeller.

Then, the image holding element was picked up from the liquid after completing the image formation, and it was confirmed that a high quality image having a optical image density of 1.51 was formed on the surface of the image holding element and that the scattering of the optical density of the solid area was $\sigma$=0.05. The optical image density of Example 2 was 1.53, and the scattering of the optical density of the solid area of Example 2 was $\sigma$=0.09.

Example 10 (Controlling of Liquid Temperature)

The same dispersion of coloring material fine particles as described in Example 2, was prepared in the same manner as described in Example 2.

Then, using the same device as described in Example 2 shown in FIG. 3, 5.0 V of D.C. pulse voltage (pulse width 2 ms/pulse period 3 ms) was applied between the work electrode and the opposite electrode from the potentiostat power source with inputting image to the photo-image input area of the image holding element by He—Ne laser light. At the time, print recording was carried out with controlling liquid temperature of the dispersion in the bath with a temperature controlling device in the dispersion bath.

Then, the image holding element was picked up from the liquid after completing the image formation, and it was confirmed that a high quality image having a optical image density of 1.56 was formed on the surface of the image holding element and that the scattering of the optical density of the solid area was $\sigma$=0.07. The optical image density of Example 2 was 1.57 and optical density of the solid area of Example 2was $\sigma$=0.09.

Example 11 (Influence on Shelf Stability With or Without Mildewproofing Agent)

10 parts by weight of carbon black powders (average particle diameter: 0.1 $\mu$m), 15 parts by weight of diethylene glycol, 3 parts by weight of polyoxyethylene alkyl ether sodium carboxylate, 3 parts by weight of polyethylene glycol sodium dicarboxylate, 6 parts by weight of water-soluble acrylic resin, 7 parts by weight of isopropanol and 55 parts by weight of distilled water were mixed and a medium degree of stirring was carrying out using a propeller for one hour so as to wet the carbon black powders sufficiently in the liquid to prepare a crude dispersion. Then, a high degree of forced-dispersing treatment of the dispersion liquid was carried out using a homogenizer dispersing device for 3 minutes to prepare a dispersion stock liquid. A diluent in which 120 parts by weight of distilled water and 10 parts by weight of glycerin were mixed, was added dropwise into the dispersion stock solution with stirring using a propeller to prepare a dispersion of coloring material fine particles.

Then, as shown in FIG. 3, an image holding element which was equipped with a work electrode capable of being inputted image signals from the reverse, was placed in the dispersion bath filled with the above described dispersion so that its reverse surface is positioned exterior of the dispersion bath, and an opposite electrode and a control electrode using salt bridge were arranged in the bath. The image holding element was formed by providing an ITO transparent conductive layer on a plate glass substrate having a thickness of 3 mm and forming a laminate structure comprising two-layered organic photoconductive layer (as described above) on the transparent conductive layer. The ITO photoconductive layer was used as a work electrode, and the organic photoconductive layer was smooth. Each electrode was connected to potentiostat power source. Then with inputting images to the photo-image input area of the reverse of the image holding element, D.C. voltage of 4.0 V was applied between the work electrode and the opposite electrode from the potentiostat power source for seven seconds.

Then, the image holding element was picked up from the liquid after completing the image formation, and it was confirmed that a high quality image having a optical image density of 1.46 was formed on the surface of the image holding element.

Then each of the dispersion of this example and of Examples1, was putted in a 300 ml of polyethylene bottle and left for three months under an atmosphere of 30° C.·90Rh %, respectively. As the results of the visual estimation, filtration and shaking estimation, the dispersion of Example 1 had the same liquid properties before the leaving test. However, in the dispersion of this example, the increase of viscosity and the existence of fine floatings in the liquid were admitted compared with the liquid properties of the leaving test.

Example 12 (Cleaning)

In the same manner as described in Example 2, a dispersion was prepared, and via a record printing process, the image holding element was putted from the dispersion bath, and a normal paper was placed on the surface of the image holding element on which an image of the dispersed coloring material fine particles. Over the paper, the normal paper and the image holding element were pressured by holding by a conductive rubber roller and an insulating rubber roller at a linear pressure of 400 g/cm to carry by rolling. Then the normal paper was pealed off from the image holding element immediately after carrying out the rollers, and a transferred image having an optical image density of 1.43 was obtained. Then, the remained image forming materials which were not transferred, were removed using a rubber blade on the surface of the image holding element. Thus the surface of the image holding element was returned to the initial condition to be used for the next image formation.

Example 13 (Influence on pH Change)

10 parts by weight of carbon black powders (average particle diameter: 0.1 μm), 15 parts by weight of diethylene glycol, 3 parts by weight of polyoxyethylene alkyl ether sodium carboxylate, 3 parts by weight of polyethylene glycol sodium dicarboxylate, 6 parts by weight of water-soluble acrylic resin, 7 parts by weight of isopropanol and 55 parts by weight of distilled water were mixed, and medium degree of stirring was carried out using a propeller for one hour so as to wet the carbon black powders sufficiently in the liquid to prepare a crude dispersion.

Then, a high degree of forced-dispersing treatment of the dispersion was carried out using a homogenizer dispersing device for 3 minutes to prepare a dispersion stock liquid. A diluent in which 120 parts by weight of distilled water, 10 parts by weight of glycerin and 0.3 part by weight of mildewproofing agent (Prokycell XL-2, ICI) were mixed, was added dropwise into the dispersion stock solution with stirring using a propeller to prepare a dispersion of coloring material fine particles. The pH of the liquid was adjusted by an aqueous hydrochloric acid solution and an aqueous sodium hydroxide solution to 4.5, 6.0, 7.5 and 9.5. The pH of the liquid at the beginning of deposition of the coloring material fine particles was 5.0.

Then, as shown in FIG. 3, the image holding element which was equipped with a work electrode capable of being inputted image signal from the reverse, was placed in the dispersion bath filled with the above dispersion so that the reverse was positioned exterior of the dispersion bath, and an opposite electrode and a controlling electrode utilizing a salt bridge were arranged in the bath. The image holding element was formed by providing an ITO transparent conductive layer on a plate glass substrate having a thickness of 4 mm and forming a laminated structure comprising two-layered organic photoconductive layer on the transparent conductive layer. The ITO electrode was used as a work electrode, and the surface of the organic photoconductive layer was smooth. Each electrode was connected to the potentionstat power source.

Then with inputting images to the photo-image input area of the reverse of the image holding element, D.C. voltage of 3.5 V was applied between the work electrode and the opposite electrode from the potentiostat power source for nine seconds.

Then, the image holding element was picked up from the liquid after completing the image formation, the optical image density of the surface of the image holding element was measured, it was confirmed that images having an optical image density of 1.55 (dispersion at pH4.5), 1.48 (dispersionatpH 6.0), 1.41 (dispersion at pH 7.5) and 1.15 (dispersion at pH 9.5) were formed. The dispersion particles of the dispersion at pH 4.5 were settled down to the bottom of the bathtub, and the dispersing condition was unstable.

Example 14

In order to prepare an aqueous coloring material liquid for electrodeposition (coloring material dispersion), 15 parts by weight of carbon black (coloring material) powders (average particle diameter: 0.1 μm), 15 parts by weight of diethylene glycol (humectant), 3 parts by weight of polyoxyethylene alkyl ether sodium carboxylate (dispersant), 3 parts by weight of polyethylene glycol sodium dicarboxylate (dispersant), 5 parts by weight of water-soluble acrylic resin (additive), 7 parts by weight of isopropanol (solvent) and 50 parts by weight of distilled water were mixed, and a medium degree of stirring was carried out using a propeller for one hour so as to wet the carbon black powders sufficiently in the liquid to prepare a crude dispersion of the coloring material dispersion.

Then, a high degree of forced-dispersing treatment of the dispersion was carried out using a homogenizer dispersing device for 3 minutes to prepare a dispersion stock liquid. A diluent in which 100 parts by weight of distilled water, 10 parts by weight of glycerin, 0.8 part by weight of mildew-proofing agent (XL-2, ICI) and 25 parts by weight of water-soluble acrylic resin were mixed, was added dropwise into the dispersion stock solution with stirring using a propeller to prepare a dispersion of coloring material particles. Filtering under pressure with a filter, an aqueous coloring material liquid for electrodeposition (dispersion of coloring material) was prepared. The pH of the liquid was adjusted by an aqueous phosphoric acid solution and an aqueous sodium hydroxide solution to 6.5. The pH of the liquid at the beginning of deposition of the coloring material particles was 5.0. The volume resistivity of the liquid was $3\times10^3$ Ω·cm.

Then, as shown in FIG. 4, an image holding element which was equipped with an ITO conductive layer as a work electrode capable of being inputted image signals from the reverse (which means a part directly applied by a voltage from exterior within the image holding element which functions as an electrode), was placed in the dispersion bath so that its reverse surface is positioned outside of the dispersion bath, and an opposite electrode and a control electrode using salt bridge were arranged in the bath.

The image holding element was prepared by providing an ITO transparent conductive layer on a plate glass substrate having a thickness of 4 mm and forming a laminate structure comprising two-layered organic photoconductive layer (two-layered structure of each pigment having a thickness of 50 nm of phthalocyanine and perylene) formed on the transparent conductive layer by vacuum deposition, and applying room temperature curing fluorine-containing silicone resin to have a thickness of 0.05 μm by a dip coating. The surface had no difference in level and was smooth, the surface roughness (Ra) was 0.2 μm, and the critical surface tension was 22 dyne/cm.

Each electrode of the image holding element was connected to potentiostat power source. Then with inputting images to the photo-image input area of the reverse of the image holding element, D.C. voltage of 2.0 V was applied between the work electrode and the opposite electrode from the potentiostat power source for 19 seconds. Thus a black colored image was formed on the surface of the image holding element.

Then, the image holding element was picked up from the liquid after completing the image formation, and a copy paper was placed on the surface of the image holding element surface. The element was arranged on a plate press device and pressed under pressure of area pressure of 500 g/cm$^2$, then the copy paper was pealed off from the image holding element and it was confirmed that a image having a high optical image density of 1.37 was formed on the copy paper.

Example 15

In order to prepare an aqueous coloring material liquid for electrodeposition (dispersion of the coloring material particle), 20 parts by weight of carbon black powders (average particle diameter: 0.07 $\mu$m), 10 parts by weight of polyethylene glycol, 5 parts by weight of polymethyl acrylate ammonium dicarboxylate, 5 parts by weight of polyoxyethylene alkyl phenyl ammonium carboxylate, 6 parts by weight of water-soluble acrylic resin, 10 parts by weight of isopropanol and 50 parts by weight of distilled water were mixed, and a medium degree of stirring was carried out using a propeller for three hours so as to wet the carbon black powders sufficiently in liquids to prepare a crude dispersion.

Then, a dispersing treatment of the dispersion was carried out using a ball mill dispersing device for 24 hours to prepare a dispersion stock liquid. A diluent in which 200 parts by weight of distilled water, 20 parts by weight of glycerin, 0.5 part by weight of mildewproofing agent (Prokycell XL-2, ICI) and 50 parts by weight of vinyl acetate emulsion liquid were mixed, was added dropwise into the dispersion stock liquid with stirring using a propeller to prepare a dispersion of coloring material particles. The pH of the liquid was adjusted by an aqueous phosphoric acid solution and an aqueous ammonia solution to 6.0. The pH of the liquid at the beginning of deposition of the coloring material was 5.0. The volume resistivity of the liquid was $5\times10^2$ Ω·cm.

Then, using the same device as Example 1 as shown in FIG. 4, an image holding element which was equipped with an ITO conductive layer as a work electrode capable of being inputted image signals from the reverse, was placed in the dispersion bath filled with the above-described dispersion so that its reverse surface is positioned exterior of the dispersion bath, and an opposite electrode and a control electrode using salt bridge were arranged in the bath.

The image holding element was prepared by providing an ITO transparent conductive layer on a quarts substrate having a thickness of 5 mm and forming a laminate structure comprising two-layered organic photoconductive layer formed on it, and applying room temperature curing fluorine-containing silicone resin to have a thickness of 0.03 $\mu$m on the surface by dip coating. The surface was made smooth, the surface roughness (Ra) was 0.08 m, and the critical surface tension was 19 dyne/cm.

Each electrode of the image holding element was connected to a potentiostat power source. Then with inputting images to the photo-image input area of the reverse of the image holding element by He—Ne laser light, D.C. pulse voltage of 3.0 V (pulse width 2 ms/pulse period 3 ms) was applied between the work electrode and the opposite electrode from the potentiostat power source. Thus a black colored image was formed on the surface of the image holding element. The permeability of the quarts substrate having a thickness of 5 mm to the He—Ne laser light was 94%.

Then, the image holding element was picked up from the liquid after completing the image formation, and a copy paper was placed on the surface of the image holding element. The element on which the paper was placed, was passed through the rubber rollers having a surface temperature of 90° C. under a linear pressure of 100 g/cm to carry out image transfer. The copy paper was pealed off from the image holding element, and it was confirmed that a high quality image having an optical image density of 1.51 was formed on the copy paper.

Example 16

In order to prepare an aqueous coloring material liquid for electrodeposition, 10 parts by weight of phthalocyanine dye (having two or more carboxyl groups as dissociation groups into water), 10 parts by weight of ethyl cellosolve, 6 parts by weight of water-soluble acrylic resin, 10 parts by weight of isopropanol and 50 parts by weight of distilled water were mixed, and a medium degree of stirring was carried out using a propeller for a half hour to prepare a dye stock liquid.

A diluent in which 160 parts by weight of distilled water, 20 parts by weight of diethylene glycol, 0.5 part by weight of mildewproofing agent (Prokycell XL-2, ICI) and 50 parts by weight of water-soluble vinyl acetate emulsion liquid were mixed, was added dropwise into the dye stock liquid with stirring using propeller to prepare a aqueous coloring material liquid for electrodeposition. The pH of the liquid was adjusted by an aqueous phosphoric acid solution and an aqueous lithium hydroxide solution to 7.0. The pH of the liquid at the beginning of deposition of the coloring material was 4.0. The volume resistivity of the solution was $7\times10^2$ Ω·cm.

Then, using the device as shown in FIG. 6, an image holding element was placed in the electrodeposition liquid bath filled with the above-described aqueous coloring material liquid for electrodeposition, so that its reverse surface is positioned exterior of the electrodeposition liquid bath, and an opposite electrode and a control electrode using salt bridge were arranged in the bath. The image holding element provides a conductive layer controlling the current diffusion, in which Ni lines having a thickness of 2 mm and a diameter of 15 $\mu$m were lined perpendicularly in the direction of its width to be fixed with an insulating resin. The surface which contacted with the liquid of the conductive layer had a surface roughness (Ra) of 0.22 $\mu$m and the critical surface tension was 21 dyne/cm.

Then each electrode was connected with the control power source. Image was inputted to the image input area of the surface of the reverse of the image holding element using a needle electrode image input printing head of 400DPI, and a D.C. pulse voltage of 1.8 V (pulse width lms/pulse period 2 ms) was applied between the needle electrode and the counter electrode with synchronizing with the scanning rate of the printing head. The D.C. pulse voltage of 1.8 V was applied between the needle electrode and the opposite electrode to carry out printing.

Then the image holding element was picked up from the liquid after completing the image formation, liquid content was removed, and from the upper part, the image area was charged by corona discharging. The printing paper was placed on it, and the element on which the paper was placed was passed through the rubber rollers having bias voltage of 200 V under pressure at a linear pressure of 100 g/cm. The printing paper was pealed off from the image holding element and it was confirmed that a cyanogen colored image having a high image quality having optical image densities of 1.41 and 1.05 was formed on the printing paper.

Example 17

In order to prepare an aqueous coloring material liquid for electrodeposition, 20 parts by weight of carbon black powder (average particle diameter: 0.07 μm), 10 parts by weight of polyethylene glycol, 5parts by weight of polymethyl acrylate ammonium dicarboxylate, 5 parts by weight of polyoxy ethylene alkyl phenyl ammonium carboxylate, 6 parts by weight of water-soluble acrylic resin, 10 parts by weight of isopropanol and 50 parts by weight of distilled water were mixed, and a medium degree of stirring was carried out using a propeller for three hours to wet the carbon black powders into liquids sufficiently to prepare a crude dispersion.

Then, a dispersing treatment of the dispersion was carried out using a ball mill dispersing device for 24 hours to prepare a dispersion stock liquid. A diluent in which 200 parts by weight of distilled water, 20 parts by weight of glycerin, 6 parts by weight of pyrrole and 0.5 part by weight of mildewproofing agent (Prokycell XL-2, ICI) were mixed, was added dropwise into the dispersion stock liquid with stirring using a propeller to prepare a dispersion of coloring material particles. The pH of the liquid was adjusted by an aqueous phosphoric acid solution and an aqueous ammonia solution to 6.3. The pH of the liquid at the beginning of deposition of the coloring material was 4.8. The volume resistivity of the liquid was $4\times10^2$ Ω·cm.

Then, using the same device as Example 14 as shown in FIG. 4, an image holding element which was equipped with an ITO conductive layer as a work electrode capable of being inputted image signals from the reverse, was placed in the dispersion bath filled with the above-described dispersion so that its reverse surface did not contact with the dispersion liquid and was positioned exterior of the dispersion bath, and an opposite electrode and control electrode using salt bridge were arranged in the bath.

The image holding element was formed by providing a patterned ITO transparent conductive layer on polyimide film having a thickness of 75 μm as shown in FIG. 8, forming a heating element layer having a thickness of 0.3 μm in which indium oxide and silicon oxide were mixed by a high frequency sputtering method on it, providing an ITO transparent conductive layer on it, making film of the above organic photoconductive layer having two-layered structure by a vacuum deposition on it, and providing a thin film of low surface energy layer on the surface so as to prepare an image holding element having a transparent heating element layer. The surface of the image holding element was smooth, and the surface roughness (Ra) was 0.07 μm, and the critical surface tension was 23 dyne/cm.

Then the ITO conductive layer was used as a work electrode and each electrode was connected to a potentiostat power source. With inputting images to the photo-image input area of the reverse of the image holding element by He—Ne laser light, D.C. voltage of 2.2 V was applied between the work electrode and the opposite electrode. Thus a black colored image was formed on the surface of the image holding element. The permeability of the quarts substrate polyimide film having a thickness of 5 mm against the He—Ne laser light was 79%, and that of the heating element layer was 96%.

Then the image holding element was moved from the liquid after completing the image formation, and roll paper for copy was contacted with the surface of the image holding element. DC pulse voltage was input to the pattern ITO electrode layer on the point where the image holding element and rolling paper were pressured with linear pressure of 150 g/cm, the temperature of the roller surface under pressure was heated to 90° C., the paper was passed through the rubber rollers for pressuring, an image transfer was carried out, and the copy paper was pealed off from the image holding element. It was confirmed that a high quality image having an optical image density of 1.53 was formed on the copy paper. Although the residual coloring materials was not scarcely shown after transfer, the surface cleaning was carried out by web and the image holding element was returned to the initial condition. With the belt-shaped image holding element as in this example, each step of printing, transfer, cleaning of the element can be carried out continuously and proceeded simultaneously, and the recording efficiency was very good.

Example 18

In the same manner as described in Example 14, a dispersion of coloring material particles were prepared, and via a record printing process, an image holding element was removed from the dispersion bath, the liquid content was deleted, and a normal paper was placed on the image holding element surface on which an image of the dispersed coloring material particles was obtained. After carrying out the corona discharge of +6 KV from the above part of the paper, the normal paper and the image holding element were pressured by holding by a pair of rubber rollers under a linear pressure of 300 g/cm to carry by rolling. Then immediately after the pressuring, the normal paper was pealed off from the image holding element, an transferred image having an optical image density of 1.39 was obtained on the normal paper.

Example 19

15 parts by weight of carbon black powder (average particle diameter: 0.1 μm), 15 parts by weight of glycerin, 5 parts by weight of polyoxyethylene alkyl ether sodium carboxylate, 3 parts by weight of polyethylene glycol sodium dicarboxylate, 3 parts by weight of water-soluble acrylic resin, 7 parts by weight of isopropanol and 55 parts by weight of distilled water were mixed, and a medium degree of stirring was carried out using a propeller for one hour to wet the carbon black powders into the liquids sufficiently to prepare a crude dispersion.

Then, a high degree of forced-dispersing treatment of the dispersion was carried out using a homogenizer dispersing device for three minutes to prepare a dispersion stock liquid. A diluent in which 100 parts by weight of distilled water, 20 parts by weight of vinyl acetate emulsion water liquid and 0.6 part by weight of mildewproofing agent (Prokycell XL-2, ICI) were mixed, was added dropwise into the dispersion stock liquid to prepare a dispersion of coloring material particles. The pH of the liquid was adjusted by an aqueous phosphoric acid solution and an aqueous sodium hydroxide solution to 6.9. The pH of the liquid at the beginning of deposition of the coloring material was 5.2. The volume resistivity of the liquid was $5\times10^2$ Ω·cm.

Then, as shown in FIG. 4, an image holding element which was equipped with an ITO conductive layer as a work electrode capable of being inputted image signals from the reverse, was placed in the dispersion bath filled with the above-described dispersion so that its reverse surface was positioned exterior of the dispersion liquid bath, and an opposite electrode and a control electrode using salt bridge were arranged in the bath.

The image holding element was formed by providing an ITO transparent conductive layer on a plate glass substrate having a thickness of 4 mm and forming a laminated structure of two-layered above organic photoconductive layer on it. The surface of the organic photoconductive layer was smooth and the surface roughness (Ra) was 0.15 μm, and the critical surface tension was 17 dyne/cm. Each electrode was connected to a potentiostat power source. With inputting images to the photo-image input area of the reverse of the image holding element, D.C. voltage of 2.2 V was applied between the work electrode and the opposite electrode for nine seconds. Thus a black colored image was formed on the surface of the image holding element.

Then, the image holding element after completing the image formation was picked up from the liquid, a copy paper was placed on the surface of the image holding element, the element was set on the plate press machine, a heating and pressuring press was carried out under an area pressure of 200 g/cm$^2$ and at a heating temperature of 80° C., and the copy paper was pealed off from the image holding element. It was confirmed that a high quality image was formed having an optical image density of 1.42 was formed on the copy paper.

As the results of a fixing test by rubbing eraser, the change of the optical density of a printing sample of this example was 0.15. The change of the optical density of a printing sample of Example 1 was 0.4. It was confirmed that the fixing property was improved by the addition of the emulsion water solution.

Example 20

As the same manner as described in Example 15, the same dispersion liquid of coloring material particles as Example 2 was prepared.

Then using the same device as Example 2 as shown in FIG. 4, with inputting image to the photo-image input area of the reverse of the image holding element by He—Ne laser light, D.C. pulse voltage of 5.0 V (pulse width 1 ms/pulse period 3 ms) was applied between the work electrode and the opposite electrode from the potentiostat power source. At the time, a temperature controlling device was arranged in the dispersion bath, a print recording was carried out at a predetermined temperature with controlling the temperature of the dispersion in the bath.

Then, image holding element was removed from the liquid after forming an image, a copy paper was placed on the image holding element surface, the element on which the paper was placed was passed through the rubber rollers having a roller surface temperature of 90° C. under a linear pressure of 100 g/cm to transfer an image, and the copy paper was pealed off from the image holding element. It was confirmed that a high quality image having an optical image density of 1.51 was formed and that the diffusion of the optical density on the solids part was σ=0.03. The optical image density of Example 2 was 1.51 and the diffusion of the optical density was σ=0.08.

Example 21

In order to prepare an aqueous coloring material liquid for electrodeposition (dispersion of coloring material particles), 10 parts by weight of carbon black powder (average particle diameter: 0.1 μm), 15 parts by weight of diethylene glycol, 3 parts by weight of polyoxy ethylene alkyl ether sodium carboxylate, 3 parts by weight of polyethylene glycol sodium dicarboxylate, 7 parts by weight of isopropanol and 55 parts by weight of distilled water were mixed and a medium degree of stirring was carried out using a propeller for one hour to wet the carbon black powders into liquids sufficiently to prepare a crude dispersion. Then, a high degree of forced-dispersing treatment of the dispersion was carried out using an ultrasonic dispersing device for thirty minutes to prepare a dispersion stock liquid. A diluent in which 100 parts by weight of distilled water, 10 parts by weight of glycerin, 40 parts by weight of starch and 10 part by weight of aqueous vinyl acetate emulsion liquid were mixed, was added dropwise into the dispersion stock liquid to prepare a dispersion of coloring material particles.

Then, as shown in FIG. 4, an image holding element which was equipped with an ITO conductive layer as a work electrode capable of being inputted image signals from the reverse, was placed in the dispersion bath filled with the above-described dispersion so that its reverse surface was positioned exterior of the dispersion liquid bath, and an opposite electrode and a control electrode using salt bridge were arranged in the bath.

The image holding element was formed by providing an ITO transparent conductive layer on plate glass substrate having a thickness of 3 mm, and forming a laminated structure of two-layered above organic photoconductive layer. The surface of the organic photoconductive layer was smooth and the surface roughness (Ra) was 0.21 μm, and the critical surface tension was 20 dyne/cm. Each electrode was connected to the potentiostat power source. With inputting images to the photo-image input area of the reverse of the image holding element, D.C. voltage of 2.3 V was applied between the work electrode and the opposite electrode from the potentiostat power source for four seconds.

Then the image holding element was removed from the liquid after completing the image formation, and a copy paper was placed on the surface of the image holding element. The element on which the paper was placed was passed through the rubber rollers having a roller surface temperature of 80° C. under a linear pressure of 200 g/cm to transfer an image. Then the copy paper was pealed off from the image holding element and it was confirmed that a high density image having an optical image density of 1.43 was formed on the copy paper.

Each of the dispersion of this example and Example 1 was putted in a 300 ml of polyethylene bottle, respectively, and left for three months under an atmosphere of 30° C.·90Rh %. As the results of visual evaluation, filtration and shaking evaluation, the dispersion of Example 1 had the same liquid properties as before the leaving test, but with the dispersion of this example, the increase of viscosity and the existence of fine floating materials in the liquid were admitted.

Example 22

In the same manner as described in Example 15, a dispersion was prepared, and via a printing process, the image holding element was removed from the dispersion bath. The surface of the image holding element was smooth, and the surface roughness (Ra) was 0.12 μm and the critical surface tension was 22 dyne/m. A normal paper was placed on the surface of the image holding element on which an image of the dispersed coloring material was obtained. From the above part of the paper, the conductive rubber roller and the insulating rubber roller were pressured at a linear voltage of 400 g/cm with holding the normal paper and the image holding element, a bias voltage of +800 v was applied to the conductive rubber roller to carry by rolling. Then the normal paper was pealed off from the image holding element immediately after the carriage of the rollers so as to obtain a transferred image having an optical density of 1.43 on the normal paper. The image holding materials remained after transfer on the surface of the image holding element were removed using a rubber blade. Thus the image holding element was turned to the initial condition, and the next image formation was ready.

Example 23

In order to prepare an aqueous coloring material liquid for electrodeposition (a dispersion of coloring material particles), 10 parts by weight of carbon black powder (average particle diameter: 0.1 μm), 15 parts by weight of diethylene glycol, 3 parts by weight of polyoxy ethylene alkyl ether sodium carboxylate, 3 parts by weight of polyethylene glycol sodium dicarboxylate, 6 parts by weight of water-soluble acrylic resin, 7 parts by weight of isopropanol and 55 parts by weight of distilled water were mixed and a medium degree of stirring was carried out using a propeller for one hour to wet the carbon black powders into liquids sufficiently to prepare a crude dispersion liquid.

Then, a high degree of forced-dispersing treatment of the dispersion was carried out using an ultrasonic dispersing device for 100 minutes to prepare a dispersion stock liquid. A diluent in which 120 parts by weight of distilled water, 10 parts by weight of glycerin and 0.3 parts by weight of mildewproofing agent XL-2, ICI) were mixed, was added dropwise into the dispersion stock liquid to prepare a dispersion of coloring material particles.

The pH of the liquid was adjusted with an aqueous hydrochloric acid solution and an aqueous sodium hydroxide solution to 4.5, 6.0, 7.5 and 9.5. The pH of the liquid at the beginning of the deposition or the coloring materials was 5.4.

Then, as shown in FIG. 5, an image holding element which was equipped with an ITO conductive layer as a work electrode capable of being inputted image signals from the reverse, was placed in the dispersion bath filled with the above-described dispersion so that its reverse surface was positioned exterior of the dispersion bath, and an opposite electrode and control electrode using salt bridge were arranged in the bath.

The image holding element was formed by providing an ITO transparent conductive layer on a plate glass substrate having a thickness of 4 mm, and forming a laminated structure of two-layered above organic photoconductive layer. The surface of the organic photoconductive layer was smooth and the surface roughness (Ra) was 0.22 μm, and the critical surface tension was 20 dyne/cm. Each electrode of the image holding element was connected to the potentiostat power source.

With inputting images to the photo-image input area of the reverse of the image holding element, D.C. voltage of 2.5 V was applied between the work electrode and the opposite electrode from the potentiostat power source for seven seconds.

Then the image holding element was removed from the liquid after completing the image formation, and a copy paper was placed on the surface of the image holding element. The element on which the paper was placed was passed through the rubber rollers having a roller surface temperature of 80° C. under a linear pressure of 200 g/cm to transfer an image. Then the copy paper was pealed off from the image holding element and it was confirmed that high quality images having an optical image density of 1.45 (a dispersion at pH 4.5), 1.42 (a dispersion at pH 6.0), 1.27 (a dispersion at pH 7.5), 1.05 (a dispersion at pH 9.5) were formed on the copy paper. In addition, in the dispersion at pH 4.5, the dispersed particles were settled down on the bottom of the bathtub and the dispersing condition was unstable.

As described above, an image having a high optical density, high resolution, low image thickness, high fastness can be formed in safely, with producing few waste products and consuming few energy by the present invention. In addition, the processes and equipments are simple, and the present invention can be applied to a small amount and many types of print production using no plate.

Therefore, the present invention can realize the various characteristics required for the image forming technologies especially for office uses.

What is claimed is:

1. A method of forming an image comprising the steps of:

preparing a device in which an image holding element which can function as one electrode of an electrodes pair and which has a surface for holding an image and an opposite electrode which is the other of the electrodes pair are immersed in a dispersion of a coloring material fine particles in which ionized coloring material fine particles are dispersed in an aqueous liquid, and applying electric current to a desired area of the image holding element and the opposite electrode through the dispersion and depositing·building-up the coloring material fine particles to the desired area electrochemically to form an image.

2. A method of forming an image as claimed in claim 1, wherein the image holding element is capable of flowing electric current corresponding to pattern of the image or of forming an electric field.

3. A method of forming an image as claimed in claim 1, wherein the application of electric current is carried out so that the desired area of the image holding element has a polarity opposite to the polarity of the ionized coloring material fine particles.

4. A method of forming an image as claimed in claim 3, wherein the application of electric current is carried out by an applied voltage to make the potential difference of less than ±10 V between the image deposition·build-up area of the image holding element and the opposite electrode.

5. A method of forming an image as claimed in claim 1, wherein a dispersant having electric characters which bonds to, adheres to or associates with the surface of the coloring material fine particles to stabilize the dispersion of the coloring material fine particles is added.

6. A method of forming an image as claimed in claim 5, wherein one or more compounds of a structure having an anion group which is dissociated in an aqueous liquid are used as the dispersant when the image forming area of the image holding element is more anodic than the opposite electrode, and one or more compounds of a structure having a cation group which is dissociated in an aqueous liquid are used as the dispersant when the image forming area of the image holding element is more cathodic than the opposite electrode.

7. A method of forming an image as claimed in claim 6, wherein the compound of a structure having an anion group is a compound having a carboxyl group.

8. A method of forming an image as claimed in claim 1, wherein the dispersion of the coloring material fine particles further contains a monomer for electrolytic polymerization, which is deposited·built-up as a part of an image on the surface of the image holding element with polymerizing electrolytically at the time of forming an image.

9. A method of forming an image as claimed in claim 1, wherein the dispersion of the coloring material fine particles further contains an ionic water-soluble macromolecular material, which are deposited·built-up as a part of an image on the surface of the image holding element at the time of forming an image.

10. A method of forming an image as claimed in claim 1, wherein the dispersion of the coloring material fine particles further contains an emulsion particles, which are deposited as a part of an image on the surface of the image holding element at the time of forming an image.

11. A method of forming an image as claimed in claim 1, wherein the average particle diameter of the coloring material fine particles is in the range from 0.01 $\mu$m to 1.0 $\mu$m.

12. A method of forming an image as claimed in claim 1, wherein a humectant having an boiling point of 120° C. or more and a vapor pressure of 100 mmHg or less in an atmosphere is added in the aqueous solution.

13. A method of forming an image as claimed in claim 1, wherein the image holding element contains a photoconductive material which is capable of transforming an optical input as an image signal to an electric current signal, which increases the conductivity of the surface of the image holding element corresponding to the image signal to form an image.

14. A method of forming an image as claimed in claim 1, wherein an auxiliary electrode as an electrode connected to a power source is contacted or arranged on the side of non-image holding area of the image holding element, through which the image holding element functions as an electrode.

15. A method of forming an image as claimed in claim 14, wherein the auxiliary electrode is a needle or pen shaped electrode, which forms an image on the surface of the image holding element corresponding to the image signals from the auxiliary electrode.

16. A method of forming an image as claimed in claim 1, wherein the volume resistivity of the dispersion of the coloring material fine particles is $10^5$ Ω·cm or less.

17. A method of forming an image as claimed in claim 1, wherein the dispersion of the coloring material fine particles is fluidized or stirred at the time of forming an image.

18. A method of forming an image as claimed in claim 1, wherein the dispersion of the coloring material fine particles contains an agent having preservative·mildewproof effects.

19. A method of forming an image as claimed in claim 1, wherein the temperature of the dispersion of the coloring material fine particles is controlled at the, time of forming an image.

20. A method of forming an image as claimed in claim 1, wherein the method further comprises a step of removing unnecessary image forming materials deposited·built-up on the surface of the image holing element.

21. A method of forming an image as claimed in claim 1, wherein the pH value of the dispersion is set at from +0 to +4 compared with the pH point at the beginning of the deposition when the dispersed materials are deposited at the cathode, and the pH value of the dispersion is set at from −4 to 0 compared with the pH point at the beginning of the deposition when the dispersed materials are deposited at the anode.

22. A method of forming an image as claimed in claim 1, wherein the concentration of solids matters of the dispersion is in the range from 1 wt % to 40 wt %.

23. A method of forming an image as claimed in claim 1, wherein the coloring material content in the solid matters of the dispersion is in the range from 30 wt % to 80 wt %.

24. A method of forming an image as claimed in claim 1, wherein the method further comprises a step of transferring the image forming materials deposited on the image pattern area on the surface of the image holding element onto a recording medium to form an image.

25. A device for carrying out the method of forming an image as claimed in claim 1, which has:

a vessel for a dispersion of coloring material fine particles in which ionized coloring material fine particles are dispersed in an aqueous liquid, and an image holding element which is capable of functioning as one of electrodes pair and has a surface for holding an image, and an opposite electrode which is the other of the electrodes pair, set in the vessel.

26. A method of recording an image as claimed in claim 1, wherein an element having a critical surface tension of the surface of 30 dyne/cm or less is used as the image holding element.

27. A method of recording an image as claimed in claim 1, wherein an element having a surface roughness (Ra) of the surface of 0.01 $\mu$m to 1.5 $\mu$m is used as an image holding element.

28. A method of recording an images as claimed in claim 27, wherein the surface roughness (Ra) of the surface of the image holding element is 0.01 $\mu$m to 1.5 $\mu$m.

29. A method of recording an image as claimed in claim 27, wherein pH change of the aqueous liquid participates in the deposition of the coloring material.

30. A method of recording an image as claimed in claim 1, wherein the material for forming images contains a material which is melted with heat.

31. A method of recording an image as claimed in claim 1, wherein the material for forming images contains a material which is deformed and adhered with pressure.

32. A method of recording an image as claimed in claim 30, wherein the image holding element contains a heating layer which generate heats by applying electric current and which can heat the surface for holding the image, and the heating layer is generated heat at the time of transfer.

33. A method of recording an image as claimed in claim 32, wherein the heating layer can be controlled so that only the desired area can be turned in a heated condition.

34. A method of recording an image as claimed in claim 1, wherein the image holding element has a rolling belt or drum shape and carries out the deposition·build-up of the coloring material and the transfer continuously.

35. A method of recording an image as claimed in claim 1, wherein the image holding element contains a support and a photoconductive layer formed on it.

36. A method of recording an image as claimed in claim 35, wherein the support of the image holding element has a permeability of 40% or more to the light having a specific wavelength, and irradiates the light through the support so as to carry the deposition·build-up of the coloring material.

37. A method of recording images as claimed in claim 36, wherein the image holding element further contains a heating layer between the support and the photoconductive layer or on the photoconductive layer, and the heating element has permeability of 40% or more to the light having a specific wavelength and irradiates the light through the support and/or the heating layer so as to carry out the deposition·build-up of the coloring materials.

* * * * *